US012146393B2

(12) United States Patent
Pickernell et al.

(10) Patent No.: US 12,146,393 B2
(45) Date of Patent: Nov. 19, 2024

(54) WELLHEAD BOOSTING APPARATUS AND SYSTEM

(71) Applicant: Innovative Production Services SA, Tunis (TN)

(72) Inventors: Paul Pickernell, Gloucestershire (GB); Hichem Mansour, Tunis (TN)

(73) Assignee: Innovative Production Services SA, Tunis (TN)

( * ) Notice: Subject to any disclaimer, the term of this patent is extended or adjusted under 35 U.S.C. 154(b) by 188 days.

(21) Appl. No.: 17/792,734

(22) PCT Filed: Sep. 15, 2020

(86) PCT No.: PCT/GB2020/052212
§ 371 (c)(1),
(2) Date: Jul. 14, 2022

(87) PCT Pub. No.: WO2021/053324
PCT Pub. Date: Mar. 25, 2021

(65) Prior Publication Data

US 2023/0340863 A1 Oct. 26, 2023

(30) Foreign Application Priority Data

Sep. 16, 2019 (WO) ..... PCT/GB2019/052586

(51) Int. Cl.
*E21B 43/12* (2006.01)
*E21B 43/40* (2006.01)

(52) U.S. Cl.
CPC ..... *E21B 43/122* (2013.01); *E21B 43/128* (2013.01); *E21B 43/40* (2013.01)

(58) Field of Classification Search
CPC ..... E21B 43/122; E21B 43/128; E21B 43/40
See application file for complete search history.

(56) References Cited

U.S. PATENT DOCUMENTS 3,215,087 A * 11/1965 McLeod, Jr. ..... E21B 43/122 166/267
3,814,545 A * 6/1974 Waters ..... E21B 43/121 417/90

(Continued)

FOREIGN PATENT DOCUMENTS

CN 103912244 A 7/2014
CN 203783548 U 8/2014

(Continued)

OTHER PUBLICATIONS

Written Opinion of the International Searching Authority of PCT Patent Application No. PCT/GB2019/052586 issued on Aug. 4, 2020.

(Continued)

*Primary Examiner* — Matthew R Buck

(57) ABSTRACT

A wellhead boosting apparatus (14) comprising a multi-phase separator module (30) having a separator module support (32); a multi-phase separator (28), an oil-phase pump (48) for extracting an oil phase from the multi-phase separator (28), and a water-phase pump (46) for extracting a water phase from the multi-phase separator (28), the multi-phase separator (28) including a separator fluid inlet (38) comprising a wellhead connector (34), and a separator gas outlet (40) for extracting separated gas; and a compressor module (24) having a compressor module support (26); a compressor (22), a gas engine (68) which utilises separated gas as fuel for powering the compressor (22), the compressor (22) including a compressor gas inlet (50) connected with the separator gas outlet (40) and a compressor gas outlet (20) which is communicable with the wellhead (12) to provide gas lift thereto using the separated gas.

20 Claims, 13 Drawing Sheets

(56) References Cited

U.S. PATENT DOCUMENTS

| | | | | |
|---|---|---|---|---|
| 6,009,945 | A * | 1/2000 | Ricks | E21B 43/123 166/151 |
| 7,152,682 | B2 * | 12/2006 | Hopper | B01D 21/10 166/357 |
| 7,744,352 | B2 * | 6/2010 | Parr | F04B 47/04 417/198 |
| 8,113,288 | B2 * | 2/2012 | Bachtell | E21B 43/122 166/309 |
| 9,140,106 | B2 * | 9/2015 | Rexilius | E21B 43/122 |
| 10,400,548 | B2 * | 9/2019 | Wong | G06F 30/20 |
| 11,613,972 | B2 * | 3/2023 | Whiteman | E21B 43/38 166/372 |
| 2003/0070813 | A1 * | 4/2003 | Irwin, Jr. | E21B 43/122 166/372 |
| 2003/0085036 | A1 * | 5/2003 | Curtis | E21B 43/122 166/267 |
| 2005/0199391 | A1 * | 9/2005 | Cudmore | E21B 47/07 166/250.15 |
| 2008/0179063 | A1 * | 7/2008 | Smith | E21B 43/122 166/252.1 |
| 2012/0037370 | A1 * | 2/2012 | Johnson | E21B 43/40 166/57 |
| 2012/0067569 | A1 * | 3/2012 | Brown | E21B 43/122 166/267 |
| 2012/0152532 | A1 * | 6/2012 | Senties | E21B 43/122 166/250.15 |
| 2015/0218919 | A1 | 8/2015 | Beg et al. | |
| 2018/0179869 | A1 * | 6/2018 | Moffett | E21B 41/00 |

FOREIGN PATENT DOCUMENTS

| | | | | |
|---|---|---|---|---|
| CN | 106499371 | A | 3/2017 | |
| CN | 108222912 | A * | 6/2018 | |
| CN | 108625831 | A * | 10/2018 | E21B 43/006 |
| EP | 1353038 | A1 | 10/2003 | |
| GB | 2257449 | A | 1/1993 | |
| KR | 101959877 | B1 * | 3/2019 | |
| WO | WO-2007027080 | A2 * | 3/2007 | E21B 33/0355 |
| WO | WO-2017137272 | A1 * | 8/2017 | B01D 17/00 |

OTHER PUBLICATIONS

Written Opinion of the International Searching Authority of PCT Patent Application No. PCT/GB2020/052212 issued on Feb. 15, 2021.

* cited by examiner

WELLHEAD BOOSTING APPARATUS AND SYSTEM

The present invention relates to a wellhead boosting apparatus, particularly but not necessarily exclusively for increasing productivity of low energy or idle oil and gas wellheads. The invention may also be suitable to boost or make more practical weak potential wells that do not necessarily require gas lift. The invention further relates to a wellhead boosting system comprising a plurality of wellhead boosting apparatuses.

In the petroleum industry, oil wells which have insufficient reservoir pressure must be artificially boosted in order to produce. There are two main methods of boosting production.

The first method is achieved by reducing the back pressure to the wellhead to allow it to flow to a three-phase separator operating at a significantly lower pressure than compared to the export pipe network and using single-phase pumps and compressor to raise in pressure and therefore pump the oil, water and gas phases separately so that the well can once again produce and export hydrocarbon fluids.

The second method is of boosting production from the well is by use of a multistage reciprocating compressor, which increases gas pressure both for export and to be used as a continuous supply of hot gas lift local to the wellhead. The generation of hot gas lift allows the well to be artificially stimulated to allow further production all year round. This is achieved by the use of gas lift, in which gas is injected into the wellhead to aerate the fluid in the well to reduce its density. The formation pressure is then able to lift the well fluid column to force the fluid out of the wellbore.

To generate gas lift, a gas lift facility is provided having a large compressor in a central location, and gas can be pumped to the relevant wellheads from the gas lift facility. This produces the necessary gas lift. However, this requires a large amount of infrastructure and corresponding investment, and therefore is often prohibitively expensive for regions with few wells or otherwise relatively low yields.

There are other issues with the gas lift facility. The centralized compressor is a potential single point of failure; if the compressor fails, the entire boosted wellhead network will go offline, creating significant production outages.

The above-ground pipe network between the gas lift facility and the wellheads themselves are also potential points of failure. In particular, gas lift valves are prone to freezing in cold temperatures, in which natural gas hydrates, being ice-link solids which form when water and natural gas combine at high pressure and low temperature, clog the valves. This freezing mitigates some of the benefits of providing a centralized compressor facility, since although the compressor can be maintained at a central location, to identify blockages in the pipe network, maintenance must be performed over a wide geographical area.

The present invention seeks to provide a solution to the above-referenced issues which is cost-effective for low energy or idle wellheads.

According to a first aspect of the invention, there is provided a wellhead boosting apparatus comprising: a multi-phase separator module having a separator module support, a multi-phase separator, an oil-phase pump for extracting an oil phase from the multi-phase separator, and a water-phase pump for extracting a water phase from the multi-phase separator, the multi-phase separator including a separator fluid inlet comprising a wellhead connector configured to engage directly with a wellhead, and a separator gas outlet for extracting separated gas; and a compressor module having a compressor module support, a compressor, a gas engine which utilises separated gas as fuel for powering the compressor, the compressor including a compressor gas inlet which is communicable with the separator gas outlet and a compressor gas outlet which is communicable with the wellhead to provide gas lift thereto using the separated gas.

In existing system, there is a centralized facility from which lift gas is compressed and distributed to wellheads to provide gas lift. This requires significant investment to be cost-effective, and also is prone to failure, particularly in cold conditions. By providing an apparatus which is directly engagable locally at the wellhead, gas lift can be generated in situ. Not only does this significantly reduce infrastructure costs, since the apparatus is only required for a given wellhead to be boosted, but also the problem of the formation of hydrates is significantly reduced due to the proximity of the apparatus to the wellhead, meaning that there is minimal cooling of the lift gas. In addition, the heat of compression is available, which further reduces the formation of hydrates. Furthermore, where problems do arise, identification of any issues is much simplified due to the more constrained geography of the entire system.

Preferably, the separator module support and compressor module support may be formed as container units, and more preferably as twenty- or forty-foot container units.

The ability to ship the apparatus modules to a location in a convenient unit size is one of the significant advantages of the present system, and improves the ability for the apparatus to be used on a case-by-case basis.

In a preferable embodiment, the multi-phase separator may be a three-phase separator.

The use of a three-phase separator ensures that the water and oil can be separated and pumped as individual phases, and therefore do not form an emulsion. This will improve the quality of the oil extracted and returned to the central processing facility.

The multi-phase separator may include a separator water outlet and a separator oil outlet, and furthermore the separator water outlet and/or separator oil outlet may include a vertical standpipe, preferably for inhibiting sand ingress.

The provision of standpipes within the main chamber is an excellent way of keeping the liquid outflows free from particulate matter which could otherwise clog the oil and water suction lines to the pumps with solids, which in turn could damage the oil and water export pumps.

Optionally, the multi-phase separator may include a vertical mesh pad for the purposes of allowing a higher liquid level in the separator and therefore increasing the overall liquid residence time.

Improving the residence time of the oil and water phases inside the separator improves the ability for the oil and water phases to be separated efficiently. It may also provide a buffer capacity for slugging on start-up of the wellhead boosting apparatus, that is, where there is a rapid rise of liquid inflow.

The wellhead boosting apparatus may further comprise a wireless communications module.

Since there will be several apparatuses at different locations across a wellhead network, it is preferred that there is some ready means of communicating with each apparatus. The lack of a central compressor facility exacerbates this issue, and therefore the provision of a wireless communications module is highly desirable. It may also permit local fault detection to be sent to a remote location.

Preferably, the wireless communications module may include has a SIM-card-based data transmission or a satellite-based data transmission.

Many wellheads may be located in remote locations with limited options for communications. A SIM-card- or satellite-based data transmission protocol is most likely to remain operational in, for example, desert conditions. This may also reduce the need for any sort of manual intervention, effectively making each apparatus largely autonomous.

The wellhead boosting apparatus may comprise at least one operational sensor. The at least one operational sensor may comprise any or all of: a temperature sensor; a pressure sensor; a level sensor; and/or flow sensor. Furthermore, each of an oil flow sensor, a water flow sensor, and a gas flow sensor may be provided in order to provide multi-phase metering capability.

Providing a plurality of sensor types may allow for fault-detection capabilities within the wellhead boosting apparatus which can in turn reduce downtime and failure rates of the system. Having sensor for each phase also allows for the generation of a highly accurate multi-phase metering system.

At least one instrument of the wellhead boosting apparatus may be a pneumatic instrument operable by the separated gas from the multi-phase separator.

Since there is a gas output from the multi-phase separator, it is possible that the instrumentation of the apparatus can be pneumatically powered, which eliminates the need for a separate instrument air system, greatly simplifying the set up and installation of the wellhead boosting system.

Optionally, the oil-phase pump and/or the water-phase pump may comprise an elongate progressive cavity pump.

The use of progressive cavity pumps, preferably low-shear progressive cavity pumps, as opposed to traditional screw-type multi-phase pumping systems, which reduces the likelihood of the formation of oil-water emulsions in the downstream export pipework as the oil and water phases are pumped separately. The use of progressive cavity pumps, particularly in single-phase mode, can also reduce the total energy consumption of the modules, allowing for a smaller engine or generator to be provided. Pumps themselves can also assist with the low-production wellheads overcoming the pressure barrier on the main pipeline back to the central processing facility. Furthermore, the elongate shape of the pumps helps to package the compressor and separator modules into the container units.

Preferably, the gas engine may include a water-cooled muffler and at least one associated flammable gas sensor. The wellhead boosting apparatus may include a self-sustaining power supply which utilises separated gas as fuel, for example, the gas engine may drive a generator of the compressor module via an auxiliary drive shaft for providing power to the or each pump. The wellhead boosting apparatus may additionally or alternatively comprise an onboard power supply to be operable independently of a power grid.

The present apparatus can be made to be self-sustaining by utilising the gas extracted onsite. This is a significant advantage, since no external power or fuel supply may be required for the apparatus in such a scenario. In particular, the use of an onboard generator, driven by the self-sustaining gas engine, allows for direct powering of the various pumps.

The wellhead boosting apparatus may further comprise a sample quill device for injection of corrosion inhibitor into a gas export line.

It is preferred that additional equipment be provided with the apparatus which allows for additional operations to be performed which may improve the reliability of the system.

In one preferable embodiment, the apparatus may be configurable between a gas-lift mode of operation and a multi-phase export mode of operation.

Whilst the present invention is highly suited towards providing gas lift to low-energy wells, it is possible to utilise the apparatus solely in a multi-phase export mode, which vastly increases the potential utility of the present invention.

Optionally, at least one of the compressor module and multi-phase separator module is provided with flying electrical connection leads.

In the art, gas lift facilities need to be wired in situ, which significantly increases the installation and set-up times. Using pre-wired flying connections, the present container-mounted system can be installed very rapidly.

Optionally, the compressor may be a multi-stage compressor having a suction scrubber prior to each compressor cylinder. The compressor may preferably be a three-stage compressor. In a preferred embodiment, the compressor may include one or more coolers associated with a discharge of at least one compressor cylinder of the compressor.

Given that the present invention utilises a stream from a multi-phase separator, and that liquids are incompressible, it is very important that any liquid phase is extracted prior to significant compression work. The presence of suction scrubbers as part of a multi-stage compression sequence advantageously eliminates this risk, which could otherwise lead to failure. The provision of interstage coolers also makes the compression process vastly more efficient by removing the heat of compression by rejecting heat through a fin-fan cooler. This makes the compressor smaller and less capital-intensive for the same performance.

According to a second aspect of the invention, there is provided a wellhead boosting system comprising: a plurality of wellheads at different locations; a plurality of wellhead boosting apparatuses in accordance with the first aspect of the invention, each of the wellhead boosting apparatuses being associated with a corresponding wellhead to provide gas lift thereto.

The wellhead boosting system may preferably further comprise a central processing facility which is in communication with each of the plurality of wellhead boosting apparatuses.

A system which comprises a plurality of wellhead boosting apparatuses directly engaged at the respective wellheads eliminates the need for a centralized gas lift facility, which reduces the likelihood of hydrate formation within the pipe network, and can improve the efficiency of wells which would otherwise be unprofitable. Additionally, the remote communication capabilities of each individual apparatus may advantageously provide improved monitoring capabilities.

In a preferable embodiment, no central gas lift facility is provided.

The omission of a central gas lift facility is one of the advantages of the present system, since the system can be utilised with a few, otherwise unproductive, wellheads. This may allow for unproductive wellheads to be utilised without significant capital outlay.

According to a third aspect of the invention, there is provided a method of providing gas lift to a wellhead, the method comprising the steps of: a] using a multi-phase separator, extracting gas from a wellbore fluid of the wellhead; b] using a compressor, compressing the gas extracted from the separator; and c] injecting the compressed gas directly into the wellhead; wherein the multi-phase separator and compressor are each provided at or adjacent to the wellhead.

The use of a cyclical gas extraction and injection methodology at or adjacent to the wellhead allows for gas lift to be provided on an ad-hoc basis for wellheads which are otherwise unproductive. Gas lift may preferably be introduced into the well via a concentric coil tube.

According to a fourth aspect of the invention, there is provided a wellhead boosting apparatus comprising: a multi-phase separator, the multi-phase separator including a separator fluid inlet comprising a wellhead connector configured to engage with a wellhead, and a separator gas outlet for extracting separated gas, and at least one further fluid phase outlet connectable to one or more export lines; and a compressor including a compressor gas inlet which is communicable with the separator gas outlet and a compressor gas outlet; wherein the compressor gas outlet is selectably operable between a gas-lift condition in which separated gas is diverted to the wellhead to provide gas lift thereto, and a multi-phase export condition in which the separated gas is diverted to the or each export line to boost the pressure thereof.

The provision of an apparatus which can be selectively configured between a multi-phase gas export mode and a gas lift mode is highly useful since the present apparatus can then be used for not only standard export conditions, but also in a boosting condition in which low-producing wells can be maintained for a longer period of time.

According to a fifth aspect of the invention, there is provided a three-phase separator module comprising: a separator module support; a three-phase separator, the three-phase separator including a separator fluid inlet comprising a wellhead connector configured to engage with a wellhead, a separator gas outlet for extracting separated gas, a separator water outlet, and a separator oil outlet; a single-phase water pump communicable with the separator water outlet; and a single-phase oil pump communicable with the separator oil outlet.

Optionally, at least one of the single-phase water pump and single-phase oil pump is provided as a progressive cavity pump.

The provision of a separator module which has single-phase pumping capability following separation of the multi-phase well output can advantageously reduce the energy consumption thereof. This not only results in pumping efficiency improvements, but also means that the separator module can be created in a compact package, particularly where slim progressive cavity pumps are used. This is an important aspect for providing a suitably portable separator module.

According to a sixth aspect of the invention, there is provided a satellite wellhead boosting system comprising: a plurality of wellhead boosting apparatuses, each of the wellhead boosting apparatuses comprising: a multi-phase separator module having a separator module support and a multi-phase separator, the multi-phase separator including a separator fluid inlet and a separator gas outlet for extracting separated gas; and a compressor module having a compressor module support and a compressor, the compressor including a compressor gas inlet which is communicable with the separator gas outlet and a compressor gas outlet; wherein each of the plurality of multi-phase separator modules and compressor modules are selectably interchangeable and/or interconnectable to ensure redundancy in the event of failure.

A satellite system provides a smaller-scale local alternative to a central processing facility, improving the ease of maintenance, since switchover between individual modules of the apparatuses can be readily achieved without complete shutdown of production. Furthermore, this allows a small scale non-centralized processing facility to be effectively provided in a matter of days directly at a remote manifold which connects to at least one, and preferably several low energy wells, which compares very favourably with a typical twelve-month set up for a conventional facility.

According to a seventh aspect of the invention, there is provided a method of improving the output of a wellhead, the method comprising the step of: providing gas lift to the wellhead, wherein the temperature of the gas used in the gas lift process is or exceeds 60° C.

In a preferred embodiment, the temperature of the gas may be or exceed 70° C.

The gas lift is optionally provided via a wellhead boosting apparatus in accordance with the first aspect of the invention.

High temperature gas lift has the advantage of clearing waxes and asphaltenes from the wellhead, which might otherwise be inhibiting production of oil. Under central gas lift facility operation, it would be prohibitively expensive to heat the gas and transport it over long distances, and hence the operation mechanism proposed here would not be viable. As such, gas from a central gas lift facility arrives at the well cold, and is therefore incapable of being used in this manner.

Preferably, a compressor used to provide gas lift may be provided directly at or adjacent to the wellhead.

The means of heating the gas to a suitable wax cleansing temperature can be achieved by positioning the compressor performing the gas lift directly at the wellhead, thereby negating the economic nonviability of the central heated gas lift operation.

It is preferred that a rate of gas flow to the wellhead may be increased in periodic stepwise increments to initiate gas lift, and a rate of gas flow to the wellhead may be decreased in periodic stepwise decrements to cease gas lift.

The stepwise increment and decrements of the gas lift provision, generally conducted over many days, seems to result in long-term improvements to the operation of a well, even following removal of the wellhead boosting apparatus which is conducting the gas lift process. Accordingly, the wellhead boosting apparatus of the present invention can be used to improve production capabilities on otherwise non-productive wellheads.

According to an eighth aspect of the invention, there is provided a wellhead boosting apparatus comprising: a multi-phase separator module having a separator module support and a multi-phase separator, the multi-phase separator including a separator fluid inlet comprising a wellhead connector configured to engage directly with a wellhead, and a separator gas outlet for extracting separated gas; and a compressor module having a compressor module support and a compressor, the compressor including a compressor gas inlet which is communicable with the separator gas outlet and a compressor gas outlet which is communicable with the wellhead to provide gas lift thereto using the separated gas.

The invention will now be more particularly described, by way of example only, with reference to the accompanying drawings, in which.

Figure 5A:
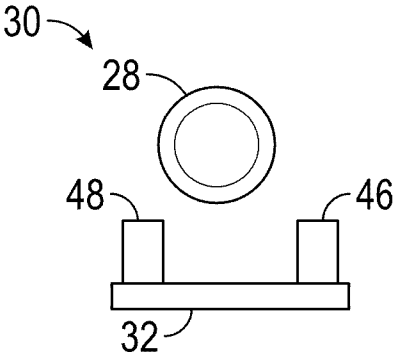
Figure 5B:
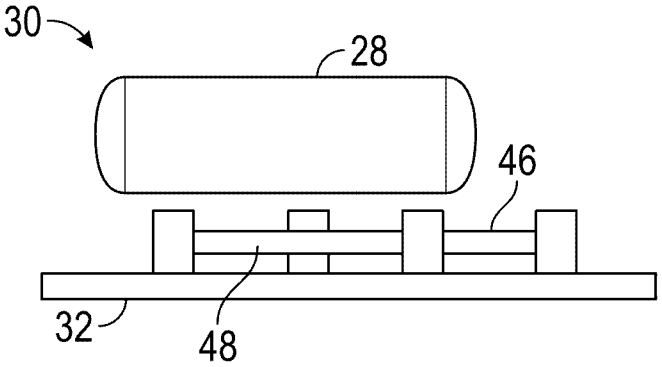

FIG. 5*a* shows an end representation of a multi-phase separator module of a fourth embodiment of a wellhead boosting apparatus in accordance with the first aspect of the invention;

FIG. 5*b* shows a side representation of the multi-phase separator module of FIG. 5*a;*

Figure 5C:
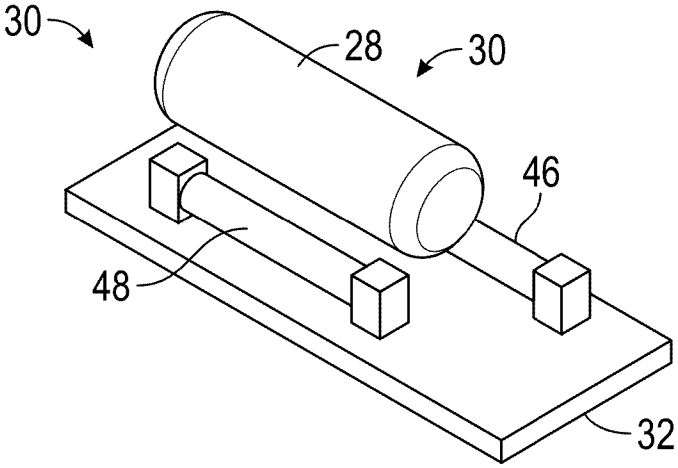

FIG. 5*c* shows a perspective representation of the multi-phase separator module of FIG. 5*a;*

Figure 5D:
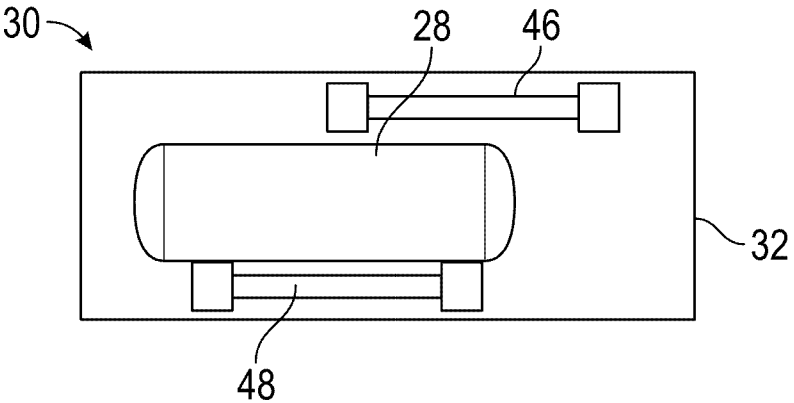

FIG. 5*d* shows a plan representation of a multi-phase separator module of FIG. 5*d;*

Figure 3:
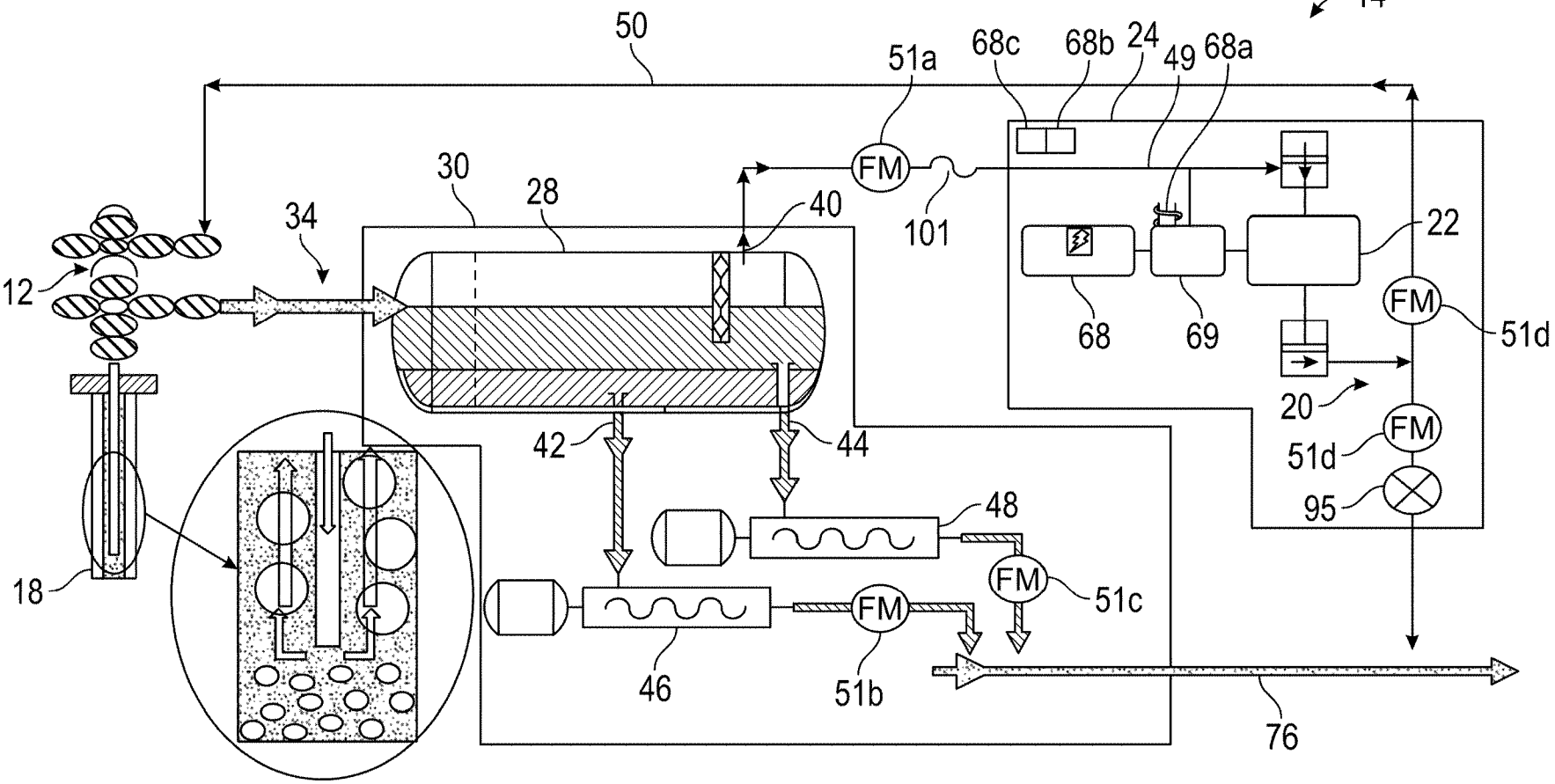
FIG. 3 shows a diagrammatic representation of a first embodiment of a wellhead boosting apparatus in accordance with the first aspect of the invention.
Figure 4:
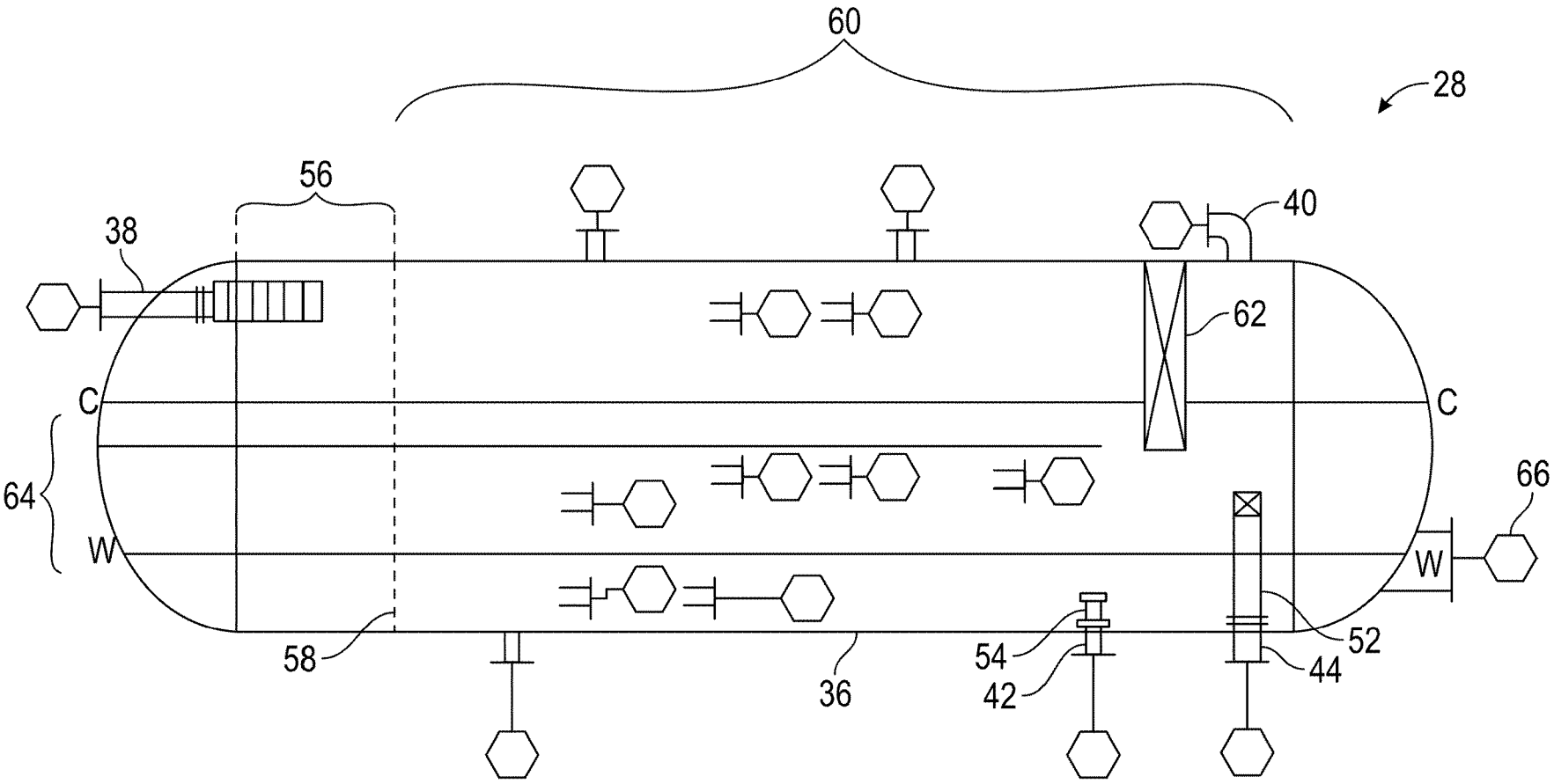
FIG. 4 shows a schematic vertical cross-section through a multi-phase separator of a third embodiment of a wellhead boosting apparatus in accordance with the first aspect of the invention.
Figure 6:
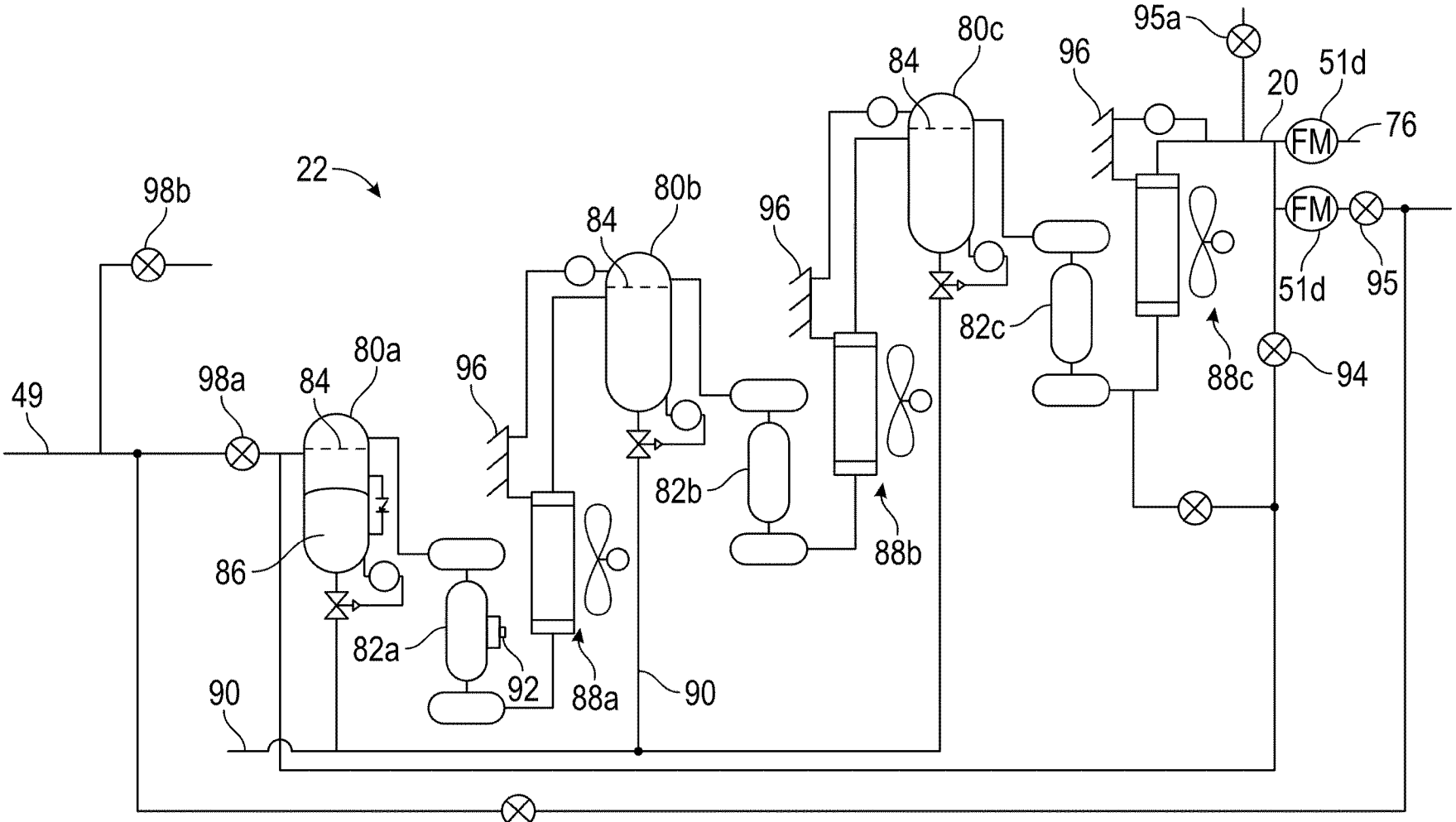
Figure 7B:
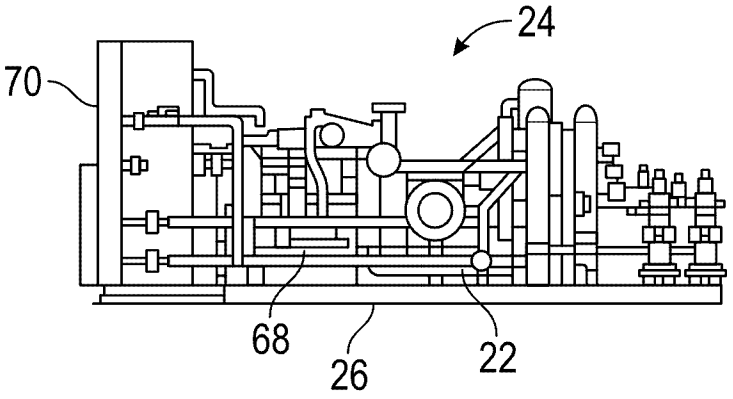
Figure 7D:
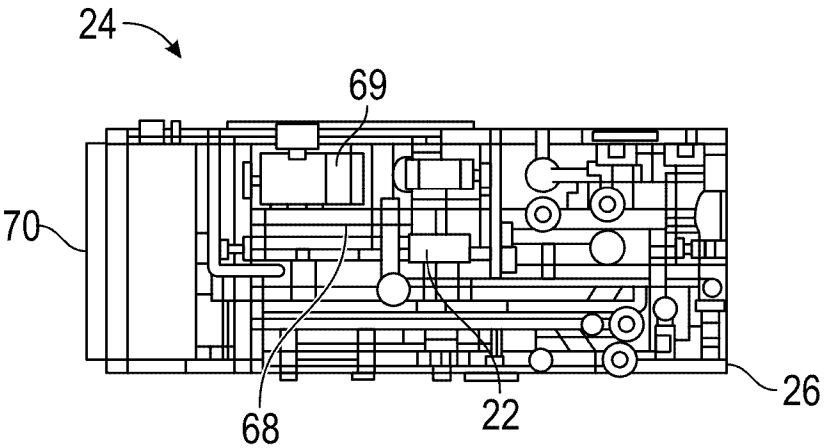
Figure 7A:
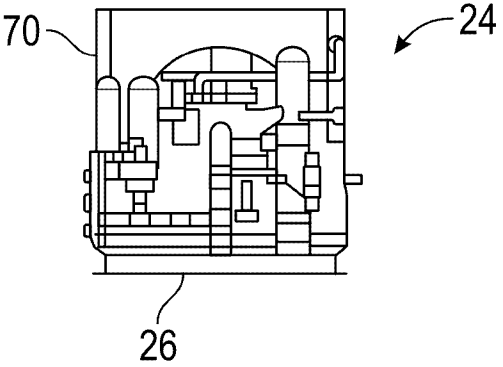

FIG. 6 shows a diagrammatic representation of the compressor configuration for the wellhead boosting apparatus of FIG. 3;

FIG. 7*a* shows an end representation of a compressor module of the fourth embodiment of the wellhead boosting apparatus in accordance with the first aspect of the invention;

FIG. 7*b* shows a side representation of the compressor module of FIG. 7*a;*

Figure 7C:
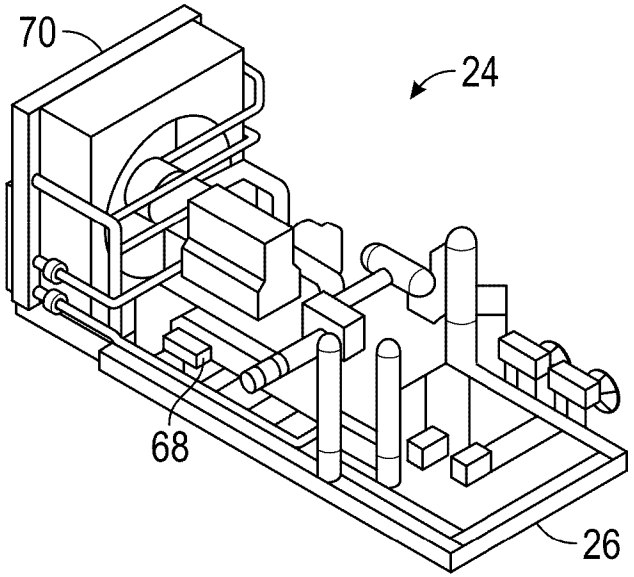

FIG. 7*c* shows a perspective representation of the compressor module of FIG. 7*a;*

FIG. 7*d* shows a plan representation of the compressor module of FIG. 7*a;*

Figure 8:
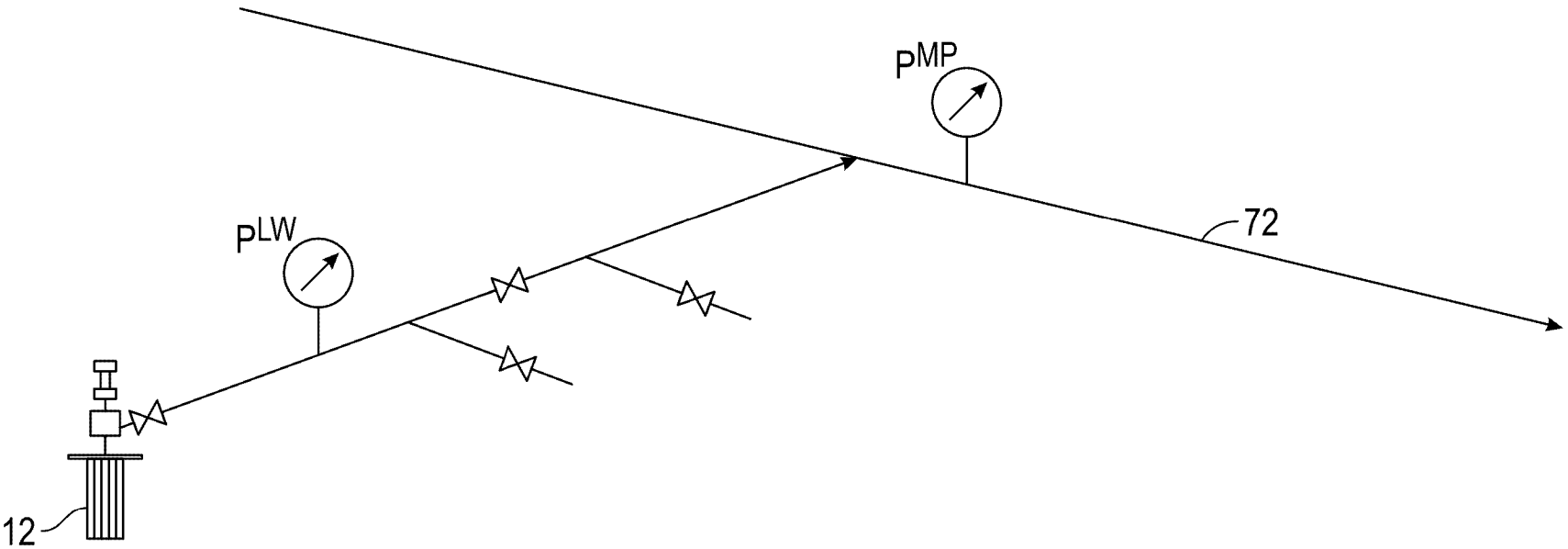
Figure 9:
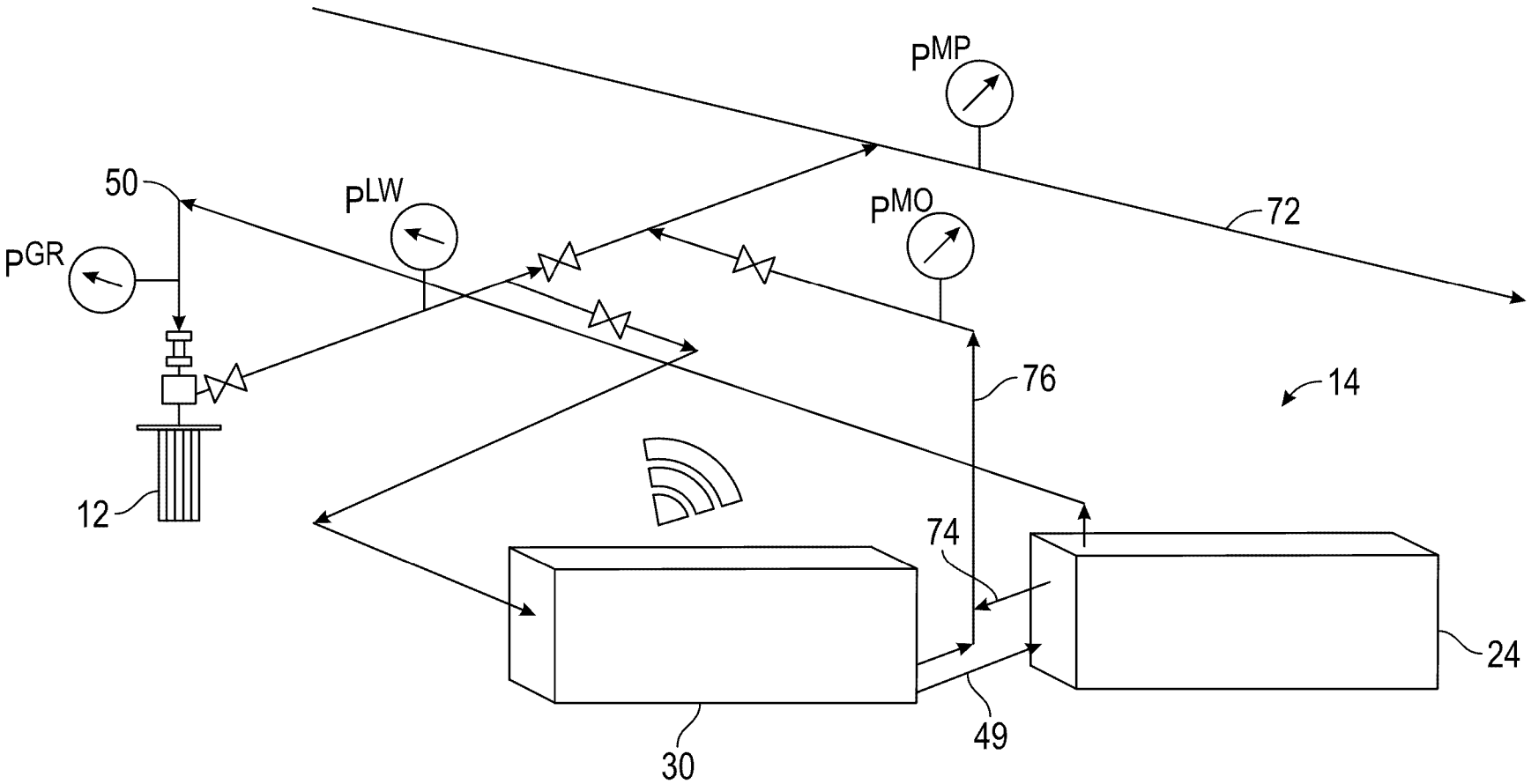
Figure 10:
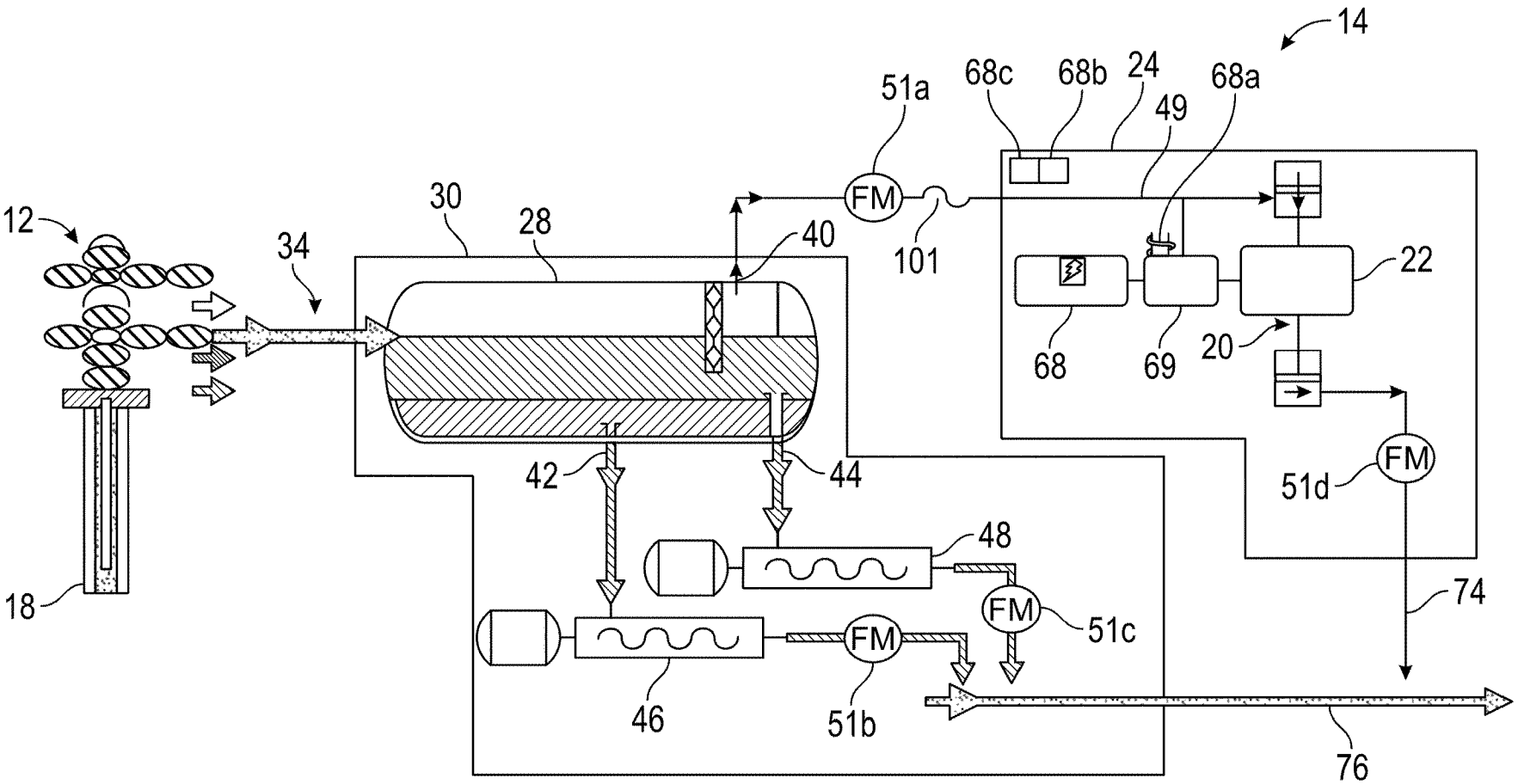
Figure 11:
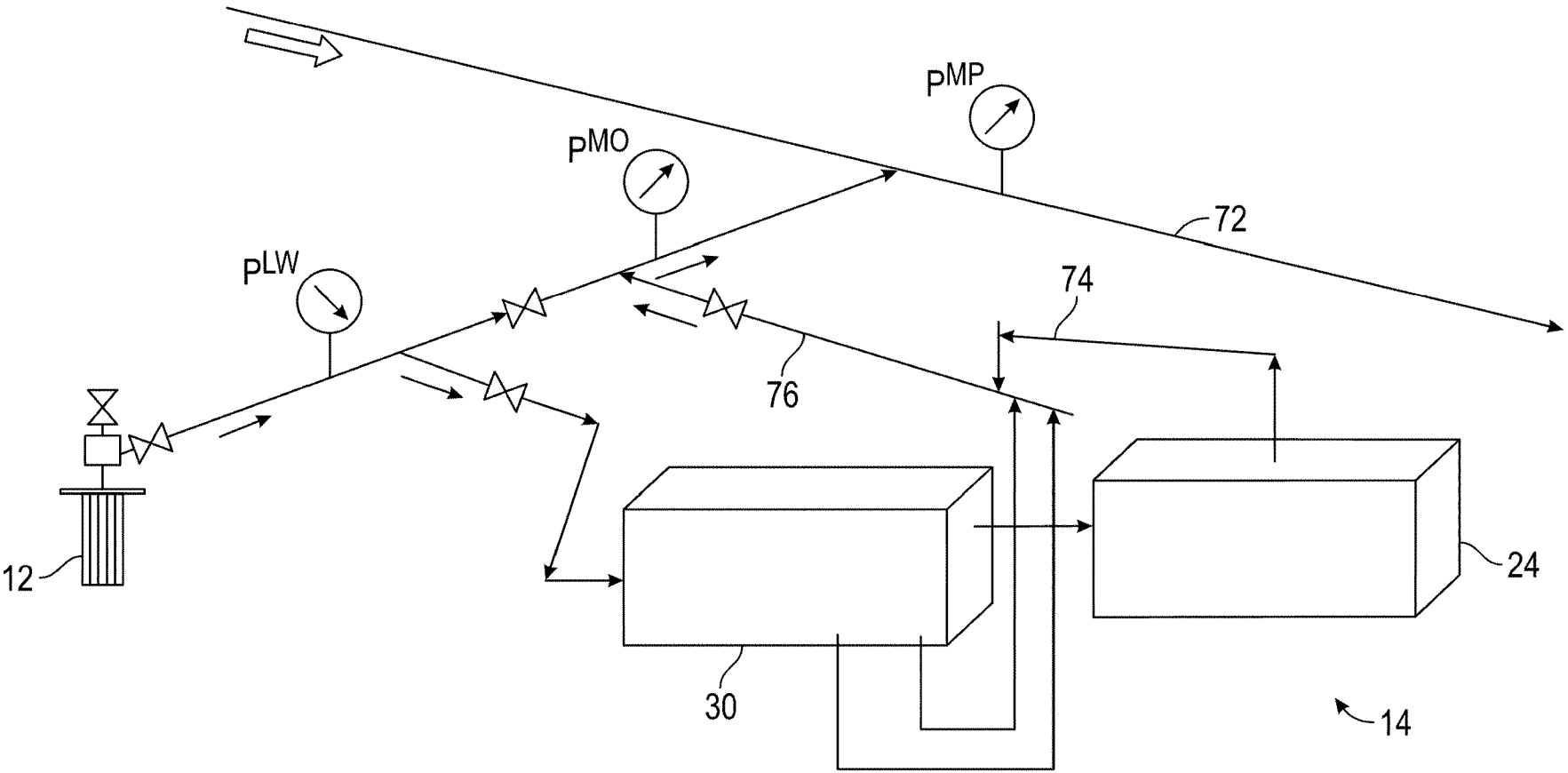
Figure 12:
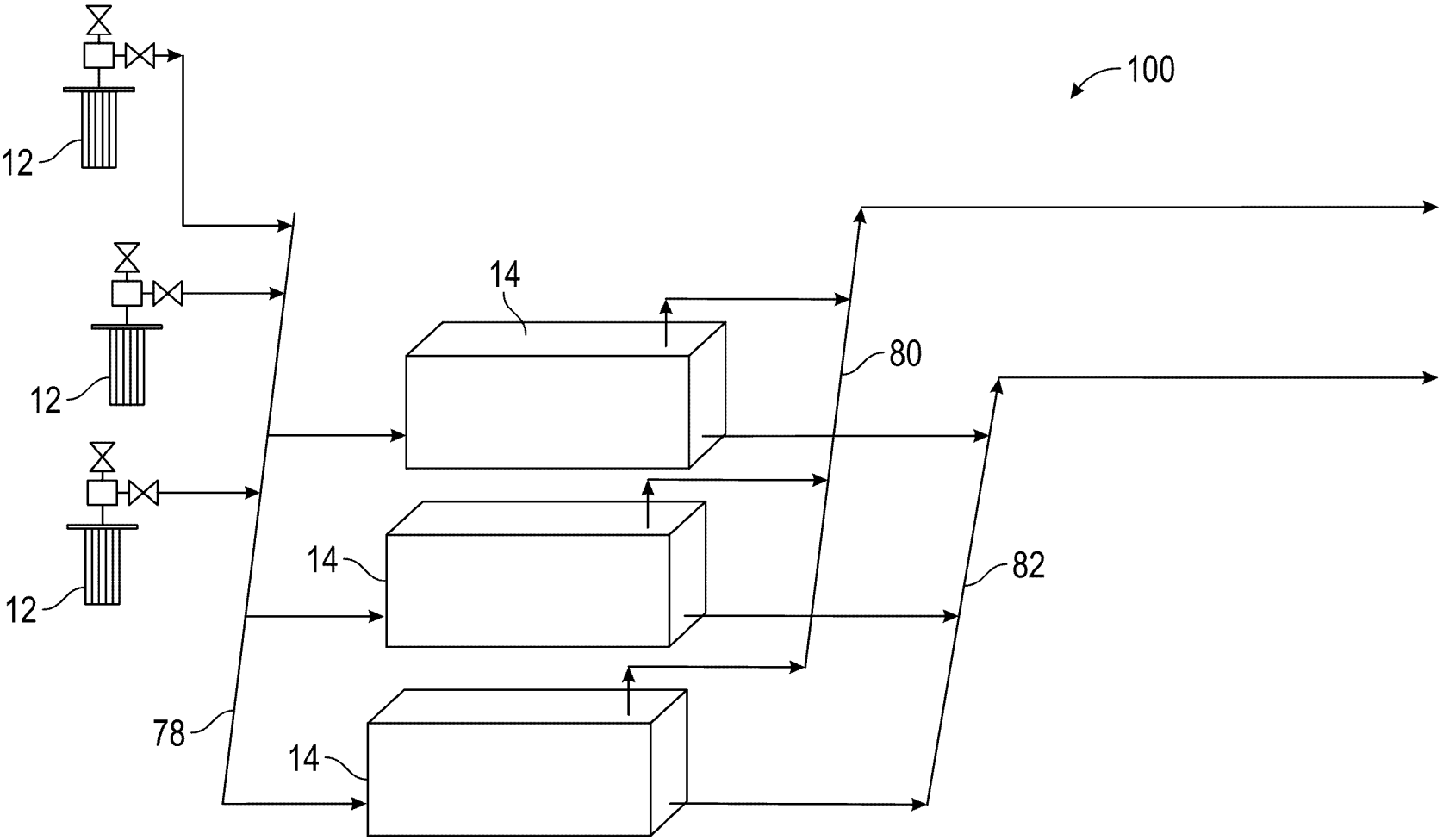
Figure 13:
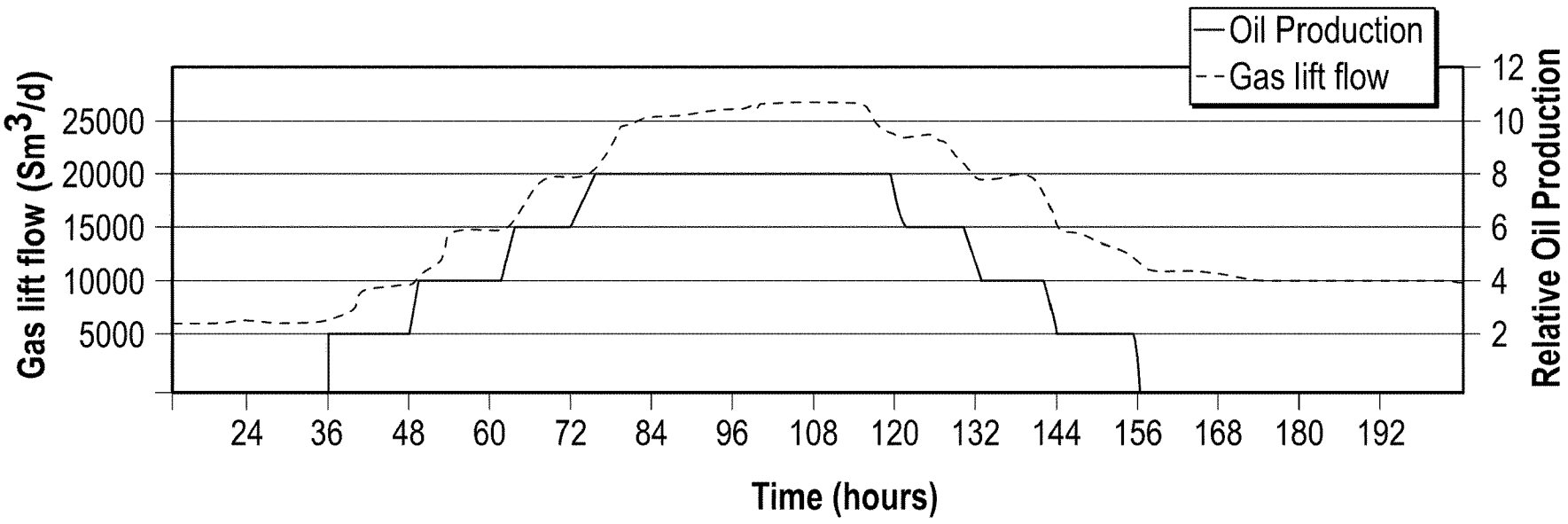

FIG. 8 shows an indicative diagrammatic representation of a low-pressure wellhead and pipeline in accordance with the state of the art;

FIG. 9 shows a diagrammatic representation of the low-pressure wellhead and pipeline of FIG. 8, inclusive of a second embodiment of a wellhead boosting apparatus in accordance with the first aspect of the invention;

FIG. 10 shows a diagrammatic representation of second configuration of the wellhead boosting apparatus of FIG. 3;

FIG. 11 shows a diagrammatic representation of second configuration of the wellhead boosting apparatus of FIG. 8;

FIG. 12 shows a diagrammatic representation of a satellite wellhead boosting facility in accordance with the sixth aspect of the invention; and FIG. 13 shows a graphical representation of a ramped gas lift production scheme using the wellhead boosting system in accordance with the second aspect of the invention.

Figure 1:
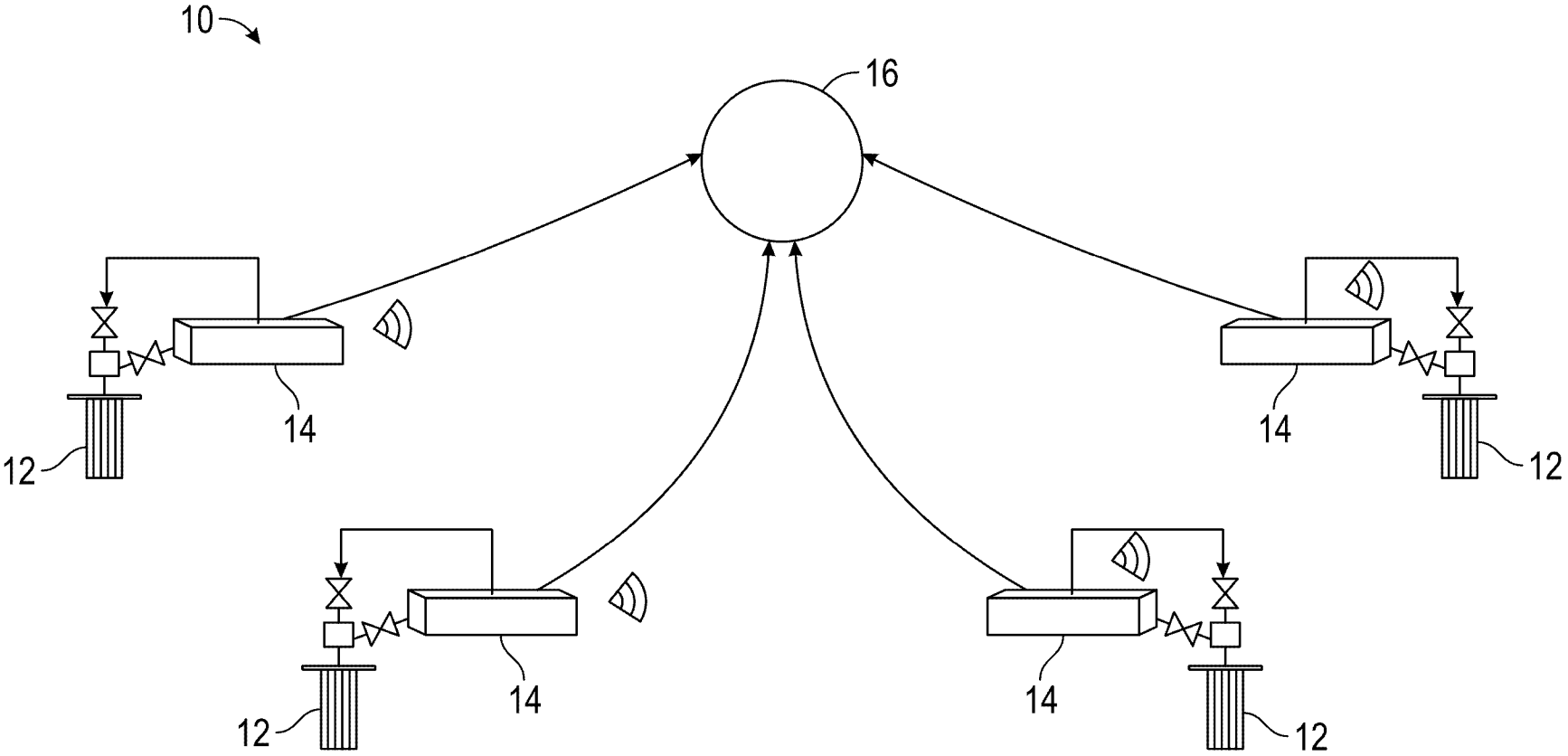
FIG. 1 shows a diagrammatic representation of one embodiment of a wellhead boosting system in accordance with the second aspect of the invention.

Referring to FIG. 1, there is indicated a wellhead boosting system, referenced globally at 10, which is suitable for providing gas lift to underperforming oil wellheads 12. This is achieved by providing a plurality of wellhead boosting apparatuses 14, each associated with an individual wellhead 12, which provide gas lift to the wellheads 12 and which are configured to send separated and recombined oil, gas and water to the central processing facility 16.

Figure 2:
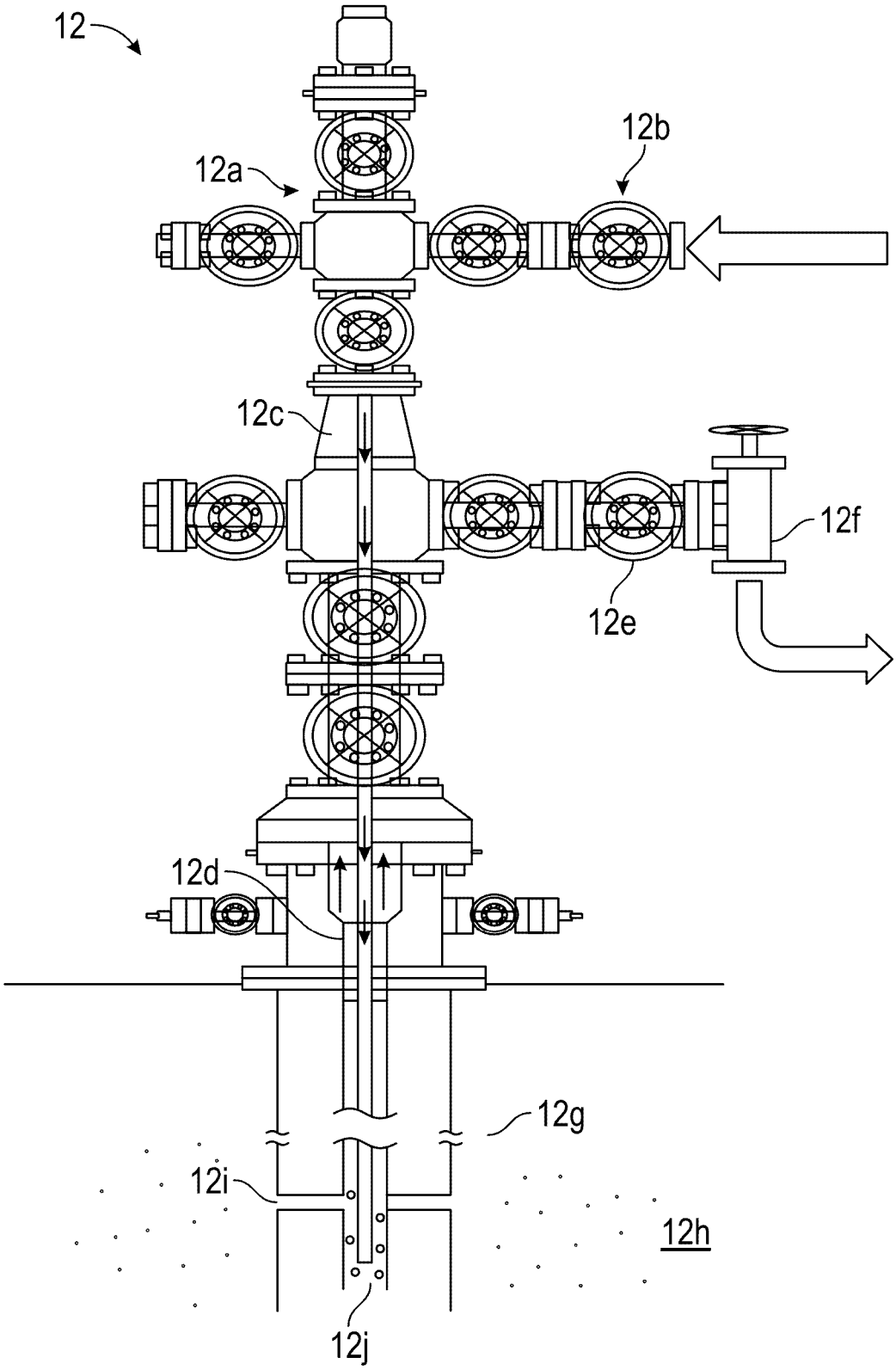
FIG. 2 shows a cross-sectional representation of a wellhead used in connection with the wellhead boosting system of FIG. 1.

An example of a wellhead 12 is shown in FIG. 2. An upper portion 12*a* of the wellhead 12 includes a gas lift inlet 12*b*, which is in communication with a conduit 12*c* extending into the well 18. The conduit 12*c* is preferably formed as a coil tube which allows for maximum thermal transfer into the well 18. Gas lift results in extraction of the oil from the well 18 via an extraction pipe 12*d*, commonly referred to as tubing, to channel oil up through the wellhead 12 and out of a well fluid outlet 12*e*. A choke valve 12*f* is provided which allows for onward connection of the wellhead 12 to downstream apparatus. The choke valve 12*f* is a throttling device to drop the wellhead pressure to line pressure.

The conduit 12*c* extends below ground, here, below the level of the sand face 12*g*, approximately 1000 to 3000 m underground, into an oil production layer 12*h* of the earth. A mixture of oil, gas and water can access the well 12 via perforations 12*i* into the well tubing 12*d*, and lift gas 12*j* injected into this region generates the gas lift effect.

The operation of a wellhead boosting apparatus 14 is indicated in FIG. 3. In order to increase the pressure in the wellhead 12, lift gas is compressed into the well 18 via a compressor gas outlet 20 of a compressor 22, connected via the gas lift inlet 12*b* of the wellhead 12, which is provided as a compressor module 24 having a compressor module support 26.

The pressure in the well 18 resulting from gas lift, which allows the well fluids in the well 18 to be forced into a multi-phase separator 28 as part of a separator module 30, having a separator module support 32, for the various components of the wellbore fluid from the well 18.

Gas lift operates by the introduction of gas into a liquid column, here, the well fluids. The pressure at the sandface of the well 18 remains constant, and the lift gas reduces the bottom hole pressure in the well 18, and the hydrostatic head is reduced due to a reduction in liquid column density. As the sand face pressure is much greater than the bottom hole pressure, production is increased. This is distinct from pneumatic displacement techniques, in which pneumatic pumping as a batch or intermittent process is used to physically displace liquids, as is the case for blowcase systems known in the art. The gas lift process herein describes is a continuous process.

The multi-phase separator 28 is connectable to the wellhead 12 via a wellhead connector 34, which engages with the choke valve 12*f* of the wellhead 12, and which comprises a conduit via which fluid can be introduced into a main chamber 36 of the multi-phase separator 28. The separator fluid inlet 38 which is connected to the wellhead connector 34, is preferably positioned at or adjacent to an upper portion of the multi-phase separator 28.

The multi-phase separator 28 is here shown as a three-phase separator for separating the gas, water and oil phases. Preferably, the multi-phase separator 28 comprises one or more progressive cavity pumps. The shape of a progressive cavity pump is long and narrow, which makes it straightforward to fit alongside the multi-phase separator 28, simplifying transportation thereof, and assists with the construction of compact compressor and separator modules 24, 30. Other advantages of a progressive cavity pump include that it is good for services where flowrate is relatively low, typically below 18 $m^3$/hr and where differential pressure is relatively high, typically greater than 15 bar $\Delta P$. Not only that, but the progressive cavity pump is robust, and has a good tolerance for solids, such as sand, whilst also being tolerant to multi-phase flows. Individual elongate oil and water pumps 46, 48 are shown, which are mounted on the separator module 30, preferably either side of the separator 28. The elongate shape of the pumps 46, 48 help to assemble the separator module 30 into a compact and easily-transportable configuration.

It may be possible, however, to provide a different type of pump, such as a multi-stage centrifugal barrel-type pump, though such motors require a large motor than a progressive cavity pump, are intolerant to changes in differential head and therefore suffer from both under- and over-thrust, and are intolerant to solids.

The multi-phase separator 28 therefore has a separator gas outlet 40, a separator water outlet 42, and a separator oil outlet 44, which respectively allow for the extraction of the gas, water and oil phases. This can be provided as three single-phase streams, or can be exported using a multi-phase pump, for example, via a water pump 46 or an oil pump 48.

Separation of the gas, oil and water occurs with the multi-phase separator 28. The gas can be directed from the separator gas outlet 40 into the compressor gas inlet 49 of the compressor 22 via a gas return line 50; thus, the separated gas can be reused for gas lift, creating a virtuous circle. The separated gas can also advantageously be used in a gas engine 68, which can then run a generator 69 via, for example, an auxiliary shaft, to provide power to the separator module 30 and/or compressor module 24. In particular, the generator 69 can be used to power the various pumps, which are preferably located on the separator module 30. The separated oil and water can then be pumped away from the multi-phase separator 28 back to a central processing facility. Thus the generator 69 is run by the gas engine 68, no external power supply is required.

The gas engine 68, if underloaded or overloaded, can stall. If the compressor 22 capacity exceed the gas supply available from suction, the compressor 22 can suck the suction pressure down below that desired by the user, potentially causing the compressor 22 to shutdown on low suction pressure. To overcome this issue, a programmable logic controller associated with the compressor 22 can be used to increase or decrease the revolutions per minute (RPM) of the gas engine 68 based on a suction pressure control signal.

The gas engine 68 has been equipped with an additional water-cooled manifold 68*a* on the exhaust muffler 68*b*. The water-cooled muffler 68*b* keeps the exhaust muffler surface temperature below the auto-ignition temperature of natural gas of 580° C., that is, the minimum temperature required to ignite the natural gas in the absence of a flame or spark. This means that the package can be given a T1 temperature rating. The T1 rating means that no surface on the equipment has a temperature greater than 450° C. The cooling medium for the muffler 68*b* is the engine auxiliary jacket water system, which rejects heat to ambient using a fin fan cooler 70.

The use of two gas detectors 68*c* located near to the engine fuel gas train, means that if there is a gas cloud over the compressor 22 during normal operation, the wellhead boosting apparatus 14 will shut down and vent hydrocarbon gas from the system 10, protecting the equipment. Considering both of these measures, the gas detector 68*c* and the water cooled manifold 68*a* means that, based on a risk assessment approach, the compressor module 20 can be given an ATEX Zone II, Group 2A, T1 hazardous area rating. The benefit of this, is that the wellhead boosting apparatus 14 can be in a zoned hazardous area, placed right next to the wellhead 12. This means that a highly packaged approach can be taken which allows all of the equipment to be installed within two container modules which can be co-located next to the wellhead 12, which very much speeds up and simplifies the installation of the equipment on site.

The wellhead boosting apparatus 14 can also serve as a multi-phase metering system, by the provision of sensors on each of the gas, oil, and water output lines. Here, there are respectively a gas flow meter 51*a*, a water flow meter 51*b*, and an oil flow meter 51*c*. This allows the flow of each of the gas, water and oil output lines to be monitored, which may be extremely useful for metering purposes. Additionally, one or more flow meters 51*d* may be provided on the gas return line 50.

FIG. 3 better illustrates the internal configuration of the main chamber 36 or pressure vessel of the multi-phase separator 28. The normal water and condensate levels in the main chamber are indicated at lines W-W and C-C respectively. For extraction purposes, a vertical standpipe 52 is provided for the separator oil outlet 44, which positions the opening of the vertical standpipe 52 within the oil phase in the main chamber 36. The separator water outlet 42 preferably includes a vertical standpipe 54 which extends into the water phase of the main chamber 36, and provides some prevention from sand ingress into the opening of the vertical standpipe 54, which will otherwise collect at the base of the main chamber 36.

The multi-phase separator 28 includes a primary separation section 56 which precedes a baffle 58, which leads into a gravity settling section 60, with a further mist extractor, here in the form of a mesh pad 62 positioned in an upper portion of the main chamber 36. The liquid, that is the water and oil, is able to settle in a liquid settling section 64 of the main chamber 36. The mesh pad 62 permits higher liquid levels to be operated in the separator 28, affording slug protection thereto.

Each of the vertical standpipes 52, 54 will preferably include a vortex breaker in order to eliminate vortices when draining the relevant liquid, which might otherwise entrain vapour and/or solid particles in the liquid stream. The standpipe 54 associated with the water phase may only be activated to drain the water outlet 42 once the water has reached a predetermined level, to avoid draining the oil erroneously, and therefore a water level sensor may be provided.

The multi-phase separator 28 operates on the principle that the three phases have different densities, which permits stratification of the gas, oil and water respectively. Solid materials, in particular sand, will also settle within the main chamber 36.

The multi-phase separator 28 also includes at least one instrument, which may include one or more sensors 66 to indicate a status of the multi-phase separator 28. This could be a temperature sensor, a pressure sensor, a level sensor, and/or flow sensor. In particular, there may be a plurality of single-phase flow meters which can be used in individually the oil, water and gas streams to provide a highly efficient multi-phase wellhead flow measurement. These flow meters are provided on external pipes, and are not positioned in the multi-phase separator 28 directly. This allows for multi-phase metering and data transmission for the wellhead boosting system 10, with information being relayed from a wireless communications module of each wellhead boosting apparatus 14, preferably a SIM-card- or satellite-based data transmission. Other communication means could be considered, such as WiMAX-type communication, or indeed any communications protocol already set-up at the site.

FIGS. 5*a* to 5*d* show the separator module 30, indicating the separator module support 32, with the pipe manifolds and connectors removed for clarity. As will be apparent, the separator module 30 which is designed to be contained within or formed as part of container unit, in particular a twenty- or forty-foot container unit, though any appropriately ISO sized container would be viable. If the container dimensions are any larger, then transportation costs are increased and packing speed decreased, thereby resulting in shipment delays to site. Additionally, the package must be shipped breakbulk, which is far more expensive. The separator module 30 has the wellhead connector 34 which extends towards the edge of the separator module support 32 to permit connection to the wellhead 12. The equipment of the separator module 30, and/or indeed the compressor module 24, could be skidded to permit easier movement. The oil and water pumps 46, 48 are also supported off the separator module 30. As can be seen, elongate pumps can be positioned either side of the separator 28 for integration into a compact configuration.

FIGS. 7*a* to 7*d* show the compressor module 24, which may not only include the compressor 22, but may also include a gas engine 68 for providing power to the wellhead boosting apparatus 14. The gas engine 68 drives the compressor 22, and may include an auxiliary shaft to run a generator 69 for providing electrical power to oil and water export pumps associated with the multi-phase separator 28. It will be appreciated, however, that other types of power supply could be provided in order to make the apparatus self-sustaining without connection to an external power grid. For example, a diesel, hybrid, or electric engine could be provided.

The gas engine 68 may be provided with an exhaust muffler cooling system which keeps surfaces cool, as well as an air cooler 70 which may be used to keep the various fluid conduits in the compressor module 24 cool. The compressor module 24, or indeed the separator module 30, may also be provided with flammable gas detectors 68*c* which can detect a gas cloud and shutdown the entire wellhead boosting apparatus 14. The compressor module 24 may also be provided with a flame detector 68*d*, which may be capable of shutting down the entire wellhead boosting apparatus 14 in the event of fire. Suction, discharge and fuel-gas fire-rated emergency shutdown valves may also be provided, which may actuate to protect the modules 24, 30 in the case of overpressure or fire. The wellhead boosting apparatus 14 may also be equipped with a blowdown valve 95*a* which will automatically vent the package in case of a fire.

The compressor 22 itself is a three-stage compressor equipped with suction and inter-stage scrubbers. This is illustrated in FIG. 6.

The compressor 22 has a suction scrubber 80*a* immediately upstream of the first stage compressor cylinder 82*a*. This is provided to remove any liquids which may have been inadvertently carried over from the gas outlet of the three-phase separator 28. Liquids are removed in order to prevent damage to the compressor cylinders 82*a*, 82*b*, 82*c* as liquids are incompressible.

Gas entering through the suction scrubber 80*a* passes through a mesh pad 84 to remove any liquid droplets prior to discharging to the first stage compression cylinder 82*a*. Liquid entering the first stage suction scrubber 80*a* drops to the bottom of the vessel where it discharges by gravity to the blowcase 86, which is a lower subsection of the first stage suction scrubber 80*a*. As the first stage suction scrubber 80*a* operates at a slightly lower pressure than the upstream three-phase separator 28, a blowcase 86 is used to push liquids back towards the three-phase separator 28. The blowcase 86 works based on a three-way valve, which actuates based on a level control signal received from the blowcase 86; acting on a high level measured in the blowcase 86. This then allows gas from the second stage discharge to pressurise the blowcase 86 with gas in order to pneumatically displace liquid back to the three-phase separator 28.

The gas exiting the first stage suction scrubber 80*a* is compressed in the first stage compression cylinder 82*a*, which is preferably provided as a doubling acting positive displacement compressor cylinder, which compresses on inbound and outbound strokes, and nominally one stage of compression will increase the pressure by 3 to 3.5 pressure ratios.

During compression, the temperature will also increase, from around 30° C. to 50° C. on the compressor cylinder suction, to approximately 120° C. to 130° C. on the discharge of the first stage compressor cylinder 82*a*. To remove the heat of compression, in order to make the next stage of compression more efficient, the gas exiting the first stage compressor cylinder 82*a* passes to a fin-fan air cooler 88*a*, which uses ambient air to cool the gas to around 50° C. to 70° C., depending on the ambient air temperature. Cooler gas is more dense so is easier to compress than hot gas, and if hot gas is compressed to a temperature above 177° C., it can start to damage the wear rings on the compression piston cylinders.

Cooling of compressed gas can cause both water and hydrocarbon liquids to condense from the gas phase, post cooling. As liquids cannot be compressed, these liquids are removed by passing the fluids exiting the cooler 88*a* through the second stage suction scrubber 80*b*, which is similar or identical in structure to the first stage suction scrubber 80*a*. This allows liquids to separate by gravity and collect in the bottom the second stage suction scrubber 80*b*. As the second stage suction scrubber 80*b* has sufficient pressure, liquids from the second stage suction scrubber 80*b* are passed under level control to the three-phase separator 28, via the drain header 90. The gas exiting the top of the second stage suction scrubber 80*b* passes through a mesh pad 84 to remove any liquid droplets prior to the gas passing the second stage of compression.

The first stage of the compressor is equipped with a variable volume cylinder pocket 92. The variable volume cylinder pocket 92 comprises a piston which can be screwed open or closed to increase or decrease the non-swept volume in the variable volume cylinder pocket 92. The greater the non-swept volume in the compressor cylinder, the less gas the cylinder can receive on the next compression stroke as the greater volume of gas, expanded from the previous stroke, prevents more fresh gas from entering the cylinder. Conversely compression capacity can be increased by closing the variable volume cylinder pocket 92.

The variable volume cylinder pocket 92 is used when the gas volume available for compression is below the flow which the compressor 22 can process at minimum engine RPM. The variable volume cylinder pocket 92 is also used when suction pressure is high to reduce flow through the compressor 22 and avoid overloading the engine.

Normally a variable volume cylinder pocket 92 is only used if it is thought that the low flowrate conditions are going to perpetuate for a long period of time. For controlling intermittent periods of low flow, the recycle valve 94 is used in conjunction with the engine RPM.

The second stage compressor cylinder 82*b* is the first of the tandem cylinders on the second throw of the compressor 22. Gas, with liquid droplets removed, passes from the second stage suction scrubber 80*b* to the second stage compressor cylinder 82*b*. Again, the second stage compressor cylinder 82*b* is preferably provided as a double acting positive displacement cylinder compressing on both inbound and out bound strokes. It will be apparent that a tandem cylinder arrangement is the preferred embodiment for the second and third stage compressor cylinders 82*b*, 82*c*, but that non-tandem cylinders could also readily be substituted.

In the second stage compressor cylinder 82*b*, pressure is raised by approximately 3 to 3.5 compression ratios, which also cause a rise in temperature due to the heat of compression. The gas is passed to a fin-fan air cooler 88*b* to cool the second stage discharge gas from 120° C. to 130° C. to 50° C. to 70° C., in order to make the third stage of compression more efficient. Cooling can cause both water and hydrocarbon condensate to occur, so the gas exiting the second stage cooler 88*b* passes to the third stage suction scrubber 80*c*. Analogous to the second stage suction scrubber 80*b*, the third stage suction scrubber 80*c* removes liquids and discharges under level control to the three-phase separator 28 via the drain header 90. The third stage suction scrubber 80*c* uses a mesh pad 84 to remove liquid prior to the gas passing to the third stage compressor cylinder 82*c*.

The third stage compressor cylinder 82*c* is the outbound part of the tandem cylinder, but it is also preferably a double acting positive displacement cylinder, which again compresses on both in-bound and outbound strokes. The third stage of compression raises the gas in pressure by approximately 3 compression ratios. To remove the heat of compression, the gas passes to the third stage discharge cooler 88*c* to be cooled to around 70° C. prior to being passed to the gas export control valves.

The discharge temperature of the gas exiting the first, second and third stages of cooling is controlled by automated variable pitch louvers 96 which act on a temperature control signal. Normally the louvers 96 will act to maintain the discharge temperature of the third stage at around 70° C. so that hydrates are prevented from forming in the concentric tubing 12*c*. The louvers 96 control the temperature by either allowing or retarding cooling air flow across the fin-fan tubes, to either increase of decrease process gas temperature, respectively.

The gas export control valve 95 on the discharge of the compressor 22 are used to direct gas to the gas lift export 50 or for export to the multiphase export line 76. Total flow is measured on the discharge of the compressor 22 using an orifice flow meter. The gas return line 50 has no control valve, which allows the compressor 22 to build pressure against the back pressure from the gas return line 50. To control the gas lift flowrate, a control valve opens or closes based on a flow control user input setting to discharge excess gas not required for gas lift to the multiphase export line 76.

For accuracy the gas export flow control valve 95, which can be either electrically or pneumatically actuated, is controlled by a programmable logic controller so that gas lift flowrate can be controller to very close tolerances, for instance, to within ±5% of the set point value. The reason for having such tight control on gas lift flowrate, is that it has been found that as gas lift performance is improved the more stable the gas lift flow supply rate is. If the gas lift flowrate is not closely controlled it can cause the well to slug which can lead to hydraulic imbalances which can cause the well to stop flowing due to a large hydraulic plug of liquid forming on the sand face of the reservoir. This, in effect, can be considered to be a great volume of liquid falling down into the tubing, preventing further production.

The inclusion of a pressure control valve 98 on the compressor 22 suction to allow the three-phase separator 28 to run in multiphase export/testing mode. This was found to be excellent for testing the well prior to putting the wellhead boosting system 10 into operation, which allowed the production to be baselined. It was also found that once gas lift was established, wellhead pressure would increase. As the wellhead pressure increased beyond the back pressure from the multiphase export line 76, the oil and water pumps could be turned off and excess gas, that is, not required for gas lift, could be exported directly to the multiphase export line 76 prior to the compressor 22, when means that this gas was no longer being flared, instead recovered to the multiphase export line 76.

Another useful valve on the compressor 22 suction, is the gas throttling valve 98*a*, which allows the three-phase separator 28 to be run at a higher pressure than the maximum suction pressure of the compressor 22. This feature is very useful when both the wellhead pressure and multiphase line export pressure are above the maximum suction pressure of the compressor 22. This means that only the gas required for gas lift can be throttled to the suction of the compressor 22 and any excess, which there always is due to the gas recycling effect of gas lift, can be discharge directly to the multiphase export line 76 prior to the compressor 22. This prevents flaring and reduces the size of the compressor 22, thereby saving on capital expenditure.

The other useful valve on the suction, was the pressure control valve 98*b* to flare, this allows the well to be tested at conditions below line pressure when the compressor 22 is turned off, or it can be used when in the compressor 22 is on but there is too much gas going to the compressor 22 suction in order to spill excess gas to flare.

A recycle valve 94 can also be provided, which is a pressure control valve which allows the discharge gas from the exit of the third stage to be recycled back to the suction 49 of the compressor 22. The recycling of gas from discharge to suction artificially loads the compressor 22. The recycle valve 94 acts on suction pressure control. The recycling of gas effectively allows the compressor 22 to be turned down to approximately 5% of total design capacity throughput without tripping the compressor 22 due to the engine being underloaded, as the recycle valve artificially loads the unit.

The wellhead boosting apparatus 14 may be operated in a pumped mode or a bypass mode configuration. This would bypass the oil and water pumps if sufficient pressure is available, in which a bypass line is provided for automatic by-pass of the package to divert the well fluids directly into the export lines. The oil and water lines may be equipped with modulating control valves to control the levels in the multi-phase separator 28 during a floating operation mode.

Furthermore, the wellhead boosting apparatus 14 may be equipped with a sample quill system for injection of corrosion inhibitor into the gas export line for downstream pipe network protection.

The oil and water pumps are controlled by variable frequency drive to maintain the levels in the multi-phase separator 28. This allows for accurate level control and secondary computation of the export flow via a programmable logic controller and variable frequency drive system.

The variable frequency drive and any other non-hazardous area components are designed to be movable to a suitable location outside of the hazardous area and may be connected using retractable, preferably pigtail, wiring, with quick-connect plug-in to the main package. The programmable logic controller is preferably the main controller for the wellhead boosting apparatus 14.

The wellhead boosting apparatus 14 is preferably configured so that a diesel generator can be plugged into the variable frequency drive, should there be insufficient gas to run the gas engine 68. This means that the separator module 30 and pumps can be run independently of the compressor 22 and power module. This may be very useful for the initial start-up of the wellhead boosting apparatus 14.

The operation of the wellhead boosting apparatus 14 is indicated in FIGS. 8 and 9. In FIG. 8, the local well pressure of the wellhead 12 is indicated at $p^{LW}$, whilst the main pipe pressure is indicated at $p^{MP}$. The local well pressure $p^{LW}$ is insufficient to flow into the main pipe 72.

In FIG. 9, the wellhead boosting apparatus 14 has been connected to the wellhead 12. The compressor module 24 provides the hot, high-pressure lift gas, injected via gas return line 50 at pressure $p^{GR}$ to the wellhead 12, with the lifted well fluid being input into the separator module 30. This yields a multiphase output, that is oil, gas and water, pressure $p^{MO}$ which is greater than the main pipe pressure $p^{MP}$ and thus improves the output from the well.

Additionally, since the gas produced from the well 18 is relatively hot—the gas is kept hot through the heat of compression and due to the limited volumes, it does not have time to cool—there is limited opportunity for hydrate freezing within the wellhead boosting apparatus 10.

It is expected that the wellhead boosting system 10 be quick to install. Each wellhead boosting apparatus 14 preferably takes no more than three to five days to rig up, particularly where existing wellhead connections are utilised.

It will be appreciated that although the present context of the use of the wellhead boosting apparatuses 14 is in land-based oil wells, it will be appreciated that this technology could well be applied in the field of offshore wells where space constraints are a major consideration with regard to installation of the equipment, as off-shore real-estate is generally at a premium.

A second configuration of the wellhead boosting apparatus 14 is shown in FIGS. 10 and 11. Identical or similar features of the invention will be referenced using identical or similar reference numerals, and further detailed description is omitted for brevity.

In this configuration, the compressor module 24 has not been set up to provide gas lift to the wellhead 12. This may either be via non-connection of the compressor 22 to the wellhead 12, as illustrated, or by closing a valve to an existing gas return line.

Instead, the multi-phase separator 28 separates the gas, oil and water phases, though it will be appreciated that the following will be applicable for a two-phase separator pumping an oil/water emulsion.

The separated gas is diverted into the compressor 22, which is then in turn exported through a further gas conduit 74 into a multi-phase export line 76. Each of the water and oil pumps 46, 48 also then export their respective phases into the multi-phase export line 76. This allows the present wellhead boosting apparatus 14 to be configured for use with existing multi-phase export lines back to the central processing facility 16.

This process might appear counter-intuitive, to separate and re-combine the three phases from the wellhead, but there are specific advantages to this process.

Firstly, the present arrangement avoids an issue known as pump slippage, where progressive cavity pumps or screw pumps do not correctly seal, and there is internal slippage of fluid within the pump. This results in high-pressure fluid migrating to low-pressure areas, reducing the efficiency of pumping. This is a much greater issue for pumping in a multi-phase mode, particularly three-phase, when compared with single-phase pumping. Typically, in three-phase mode, multi-phase pumps are only 30% hydraulically efficient, whereas a progressive cavity pump working in a single-phase more is closer to 60% hydraulic efficiency. When a reciprocating or similar compressor is also utilised, the adiabatic efficiency is of the order of 80 to 85% for the gas extraction, and therefore, there is a significant reduction in energy consumption for the present invention when compared with multi-phase pumping techniques. Typically, an engine size for pumping and compressing would be of the order of half that required for traditional multi-phase pumping.

The second benefit is illustrated in FIG. 11. Even without the addition of gas line injection using the separated gas, the separator and compressor modules 30, 24 can be used in a multi-phase export mode for improving the production of low-output wellheads 12. Pumping or compression of the individual phases extracted from the wellhead and separated by the multi-phase separator 28 allows the three phases to be diverted into the multi-phase export line 76 at a higher pressure $p^{MO}$ than that in the main pipe 72, at pressure $p^{MP}$. This is in spite of the low pressure $p^{LW}$ at the wellhead 12.

A novel arrangement of satellite wellhead boosting system 100 is indicated in FIG. 12 which is suitable for use in combination with a central processing facility. Each system 100 comprises a plurality of wellhead boosting apparatuses 14 as previously described; for clarity however, each apparatus is indicated by a single diagrammatic representation, rather than showing the separate separator and compressor modules.

In this arrangement, each of the wellhead boosting apparatuses 14 is connected to the same inlet line 78, which may be connected to a plurality of different wellheads 12. The apparatuses 14 all then export to a gas export line 80 and a bi-phase export line 82 for respectively exporting gas and oil/water emulsion. It will, of course, be appreciated that single-phase export lines could be used, or a multi-phase export line as detailed in the preceding embodiments of the invention.

The advantage of having a bank of wellhead boosting apparatuses 14, rather than an individual wellhead boosting apparatus 14 for each individual wellhead, is that there is an integral redundancy within the system 100. Each of the individual separator and compressor modules can be reconfigured with respect to one another so that, in the event of failure, there is no loss of production. The remaining active wellhead boosting apparatuses 14 would still provide the necessary boost to wellhead production. This effectively provides a modular facility in which the separator and compressor modules can be swapped in or out at will, and therefore maintenance and replacement can be performed remotely from the wellhead site or satellite facility.

An advantage of having multiple parallel units is also that this allows hook-up in a matter of days, whereas traditional constructions would take twelve to eighteen months to erect the necessary facilities.

For quick hook up, each wellhead boosting apparatus 14 may be equipped with flying leads, shown in FIGS. 3, 9 and 10 as part of a flexible connection system 101. This means the ends of the instrumentation and power cables are already pre-wired with a plug and socket type design so that the package electrical and instrumentation wiring between modules can be wired up rapidly for quick deployment of the system 10. Conventionally with oil and gas equipment, the wiring is done on site, which is fine for permanent installation but having to employ an electrician to wire in the cabling is expensive and time consuming. To get round this the wellhead boosting apparatus 14 uses pre-wired connections which can easily be plugged in on site. Also, the wellhead boosting system 10 uses flexible braided metal pipes to connect the compressor module 24 and separator module 30 together. Again, this is something which reduces rig-up time compared to using conventional welded pipe. Flexible pipes can be installed in one day whereas welded pipe can take several weeks or months to install, and these are indicated as part of the flexible connection system at 101.

It was noted during the trialling of the wellhead boosting system 10 that the natural flow conditions of the reservoir were greater after the wellhead boosting apparatus 14 had been in operation, when compared to the natural flowrate of the well before the wellhead boosting apparatus 14 was in operation. During the trial, natural flow conditions were around 4.5 $m^3$/hr before the wellhead boosting apparatus 14 on a 12.5 mm choke and 5.5 $m^3$/hr of oil production once the wellhead boosting apparatus 14 was switched off. This was an improvement of 1 $m^3$/hr Whilst the wellhead boosting apparatus 14 was in operation, using a lift gas flow rate of 20,000 $Sm^3$/d, the oil production flowrate was approximately 10.2 $m^3$/hr.

The effect that was noted is that the hot gas from the compressor 22 is being deployed into the well 12 using a concentric coil 12*c*. The concentric coil 12*c* effectively creates a hot or gas-heated rod which warms the centre of the tubing. This heat radiates out into the rising well fluids, which has a three-fold effect. Firstly, it reduces the viscosity of the oil and gas phases, reducing shear and therefore reducing drag or pressure drop on the fluid, so that a greater flowrate of fluid can be produced. Hot lift gas also removes solid build-up impurities, which inhibit flow, such waxes and asphaltenes, which melt due to the hot gas and become liquid. As these solid impurities melt, like candle wax, they are removed from the flow path, no longer inhibiting flow. This results in an increase in production. The third aspect found was that when the concentric coil end point is deployed below the sand face of the well, the rising lift gas essentially blows out sand and other debris that can be plugging the sand face, again leading to an in increase in flowrate.

It should be noted that with conventional gas lift systems, that is, where a large compression station that service several hundred wells, as the gas distribution pressure is set high, so that all wells in the system can be serviced. Where the gas lift wellhead pressure of a particular well is low, for example, a central gas lift pressure of 210 barg and an local wellhead gas lift pressure of 100 barg, there will be a 110 barg pressure drop over the wellhead gas lift choke valve. If the lift gas arrives at the wellhead for example 20° C., there will be approximately a 55° C. temperature drop. Ordinarily, there would only be a temperature drop during gas expansion of approx. 0.5° C. per 1 bar of pressure loss. taking the gas lift temperature entering the concentric coil tube down to minus 35° C. At these low temperatures, hydrate formation, wax formation and asphaltene formation are all possible. With the present wellhead boosting apparatus 14, the gas will be entering the concentric coil tube at up to 70° C., at the required gas lift injection pressure for the well and therefore no pressure drop and associated temperature drop on the wellhead, so hydrates, wax and asphaltenes are avoided.

The hot central coil radiates heat to the rising well fluids, keeping the fluids above the temperature that waxes and asphaltenes form. The higher temperature, of approximately 70° C., compared with the usual low temperatures of around 50° C., causes the melting of wax that has already formed under normal gas lift, and thereby removes the wax and asphaltenes from the flow path. This reduces friction for the rising well fluids and allows greater production and well draw down. The higher temperature, for instance, in excess of 60° C., is only achievable using the localised wellhead boosting apparatus 14. The temperature drop associated with long distance gas lift facilities does not result in this melting effect.

As a practical use of this effect, the wellhead boosting apparatus 14 could be deployed periodically on a conventional well that is under gas lift, to clean the well and remove waxes and asphaltenes. Positively, this effect appears to outlast the deployment of the wellhead boosting apparatus 14, implying that there is some sort of longer term improvement to performance due to this cleaning effect, even where the wellhead boosting apparatus 14 is removed.

What has also been discovered during trials is that if a well is ramped up in production using hot lift gas from the wellhead boosting apparatus 14 and suddenly the gas lift from the wellhead boosting apparatus 14 is stopped, this caused a liquid imbalance due to the greater flow of liquid rising up the tubing compared to natural flow. When gas lift is stopped suddenly this greater flow of liquid returns back down in the tubing and creates a hydraulic plug on the sand face of the well preventing further production.

It was discovered that the ideal way for stopping gas lift from the wellhead boosting apparatus 14 is to ramp up gas flow slowly and to ramp down gas lift flow slowing. See FIG. 12 which shows the gas lift flow being ramped up and down in 5000 $Sm^3$/d of gas increments over a 12 hour period. Increased gas lift results in a ramped increase in the oil production. However, as the gas lift ramps down, the oil production rate does not fall correspondingly quickly, and the natural well flow rate is nearly doubled for the unproductive well 18.

The main benefit of this approach was the this method did not kill the well, but as a supplementary benefit, it was found that for a well which flows naturally, the flowrate after ramp down at new natural flow condition was greater than under previous natural flow conditions. This is believed to be a side benefit of the well cleaning capabilities previously described.

Overall, the process of the present invention can be summarised as being a method of providing gas lift to a wellhead which comprises the steps of: using a multi-phase separator, extracting gas from a wellbore fluid of the wellhead; using a compressor, compressing the gas extracted from the separator; and injecting the compressed gas directly into the wellhead; wherein the multi-phase separator and compressor are each provided at or adjacent to the wellhead. This allows for a cyclical use of separated gas from the wellhead, and therefore gas lift capability does not need to be provided from a distant location.

It is therefore possible to provide a wellhead boosting apparatus and system which can be installed in situ at low-pressure wellheads on an individual basis. This eliminates the need for an expensive central gas lift facility which may only be economical where a large number of wells required boosting in a small geographical location.

This arrangement is suitable for wells which are otherwise close to their end of life, and may also benefit wells with insufficient energy for the oil to arrive at a central processing facility. This is achieved through the combination of artificial gas lift and multiphase wellhead boosting.

The system also benefits wells which have intermittent production profiles where the operator has to switch the wellhead on and off in order to recover production, since continuous flow can be achieved.

In particular, the system is ideal in areas where a traditional injection network has been deemed unviable due to uncertainties, and low-energy or idle oil wells are the best candidates for the system. This requires minimal intervention to improve the output of such low-producing wells.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined herein.

The invention claimed is:

1. A wellhead boosting apparatus comprising:

a multi-phase separator module having a separator module support, a multi-phase separator having a separator gas outlet for extracting separated gas, a separator water outlet, and a separator oil outlet, an oil-phase pump connected to the separator oil outlet for extracting an oil phase from the multi-phase separator, and a water-phase pump connected to the separator water outlet for extracting a water phase from the multi-phase separator, the multi-phase separator including a separator fluid inlet comprising a wellhead connector configured to directly engage with a wellhead; and a compressor module having a compressor module support; a compressor, a gas engine which utilises separated gas as fuel for powering the compressor, the water-phase pump and the oil-phase pump, the compressor including a compressor gas inlet which is communicable with the separator gas outlet and a compressor gas outlet which is communicable with the wellhead to provide lift gas to the wellhead and well completion in a continuous process using the separated gas to generate gas lift.

2. The wellhead boosting apparatus as claimed in claim 1, wherein the separator module support and the compressor module support are formed as twenty-foot or forty-foot container units.

3. The wellhead boosting apparatus as claimed in claim 1, wherein the multi-phase separator is a three-phase separator.

4. The wellhead boosting apparatus as claimed in claim 1, further comprising a wireless communications module.

5. The wellhead boosting apparatus as claimed in claim 1, further comprising at least one operational sensor.

6. The wellhead boosting apparatus as claimed in claim 5, wherein the at least one operational sensor comprises any or all of: a temperature sensor; a pressure sensor; a level sensor; and/or a flow sensor.

7. The wellhead boosting apparatus as claimed in claim 6, further comprising each of an oil flow sensor, a water flow sensor, and a gas flow sensor to provide multi-phase metering capability for each of the oil, gas, and water phases.

8. The wellhead boosting apparatus as claimed in claim 1, wherein the oil-phase pump and/or the water-phase pump comprises an elongate progressive cavity pump.

9. The wellhead boosting apparatus as claimed in claim 1, wherein the gas engine drives the compressor and drives a generator of the compressor module via an auxiliary drive shaft for providing electrical power to the oil-phase pump and the water-phase pump.

10. The wellhead boosting apparatus as claimed in claim 1, wherein the apparatus is configurable between a gas-lift mode of operation and a multi-phase export mode of operation.

11. The wellhead boosting apparatus as claimed in claim 1, wherein at least one of the compressor module and the multi-phase separator module is provided with flying electrical connection leads.

12. The wellhead boosting apparatus as claimed in claim 1, wherein the compressor is a multi-stage compressor having a suction scrubber prior to each compressor cylinder.

13. The wellhead boosting apparatus as claimed in claim 1, wherein the wellhead is in communication with the well completion, and the well completion comprises well tubing and a conduit extending in the well tubing, wherein the lift gas is injected into the well tubing via the conduit to provide the gas lift effect.

14. A wellhead boosting system comprising: a plurality of wellheads at different locations; a plurality of wellhead boosting apparatuses as claimed in claim 1, each of the wellhead boosting apparatuses being located at and associated with a corresponding wellhead to provide gas lift thereto.

15. The wellhead boosting system as claimed in claim 14, further comprising a central processing facility which is in communication with each of the plurality of wellhead boosting apparatuses.

16. A method of providing gas lift to a wellhead via the wellhead boosting apparatus as claimed in claim 1, the method comprising the steps of: a] using the multi-phase separator, extracting gas from a wellbore fluid of the wellhead and supplying said gas directly to the compressor; b] using the compressor, compressing the gas; and c] continuously injecting the compressed gas directly into the wellhead to provide gas lift thereto using the compressed gas; wherein the multi-phase separator and the compressor are each provided at or adjacent to the wellhead.

17. The method as claimed in claim 16, wherein during step c] the compressed gas is injected to the wellhead at a temperature that is or exceeds 60° C.

18. The method as claimed in claim 16, wherein the compressor used to provide gas lift is provided directly at or adjacent to the wellhead.

19. The method as claimed in claim 16, wherein a rate of gas flow to the wellhead is increased in periodic stepwise increments to initiate gas lift, and a rate of gas flow to the wellhead is decreased in periodic stepwise decrements to cease gas lift.

20. The method as claimed in claim 16, wherein the wellhead boosting apparatus is operated independently of a power grid.

* * * * *